US011693341B2

(12) United States Patent
Ishida

(10) Patent No.: US 11,693,341 B2
(45) Date of Patent: Jul. 4, 2023

(54) IMAGE FORMING APPARATUS

(71) Applicant: CANON KABUSHIKI KAISHA, Tokyo (JP)

(72) Inventor: Satoshi Ishida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/723,822

(22) Filed: Apr. 19, 2022

(65) Prior Publication Data

US 2022/0342351 A1 Oct. 27, 2022

(30) Foreign Application Priority Data

Apr. 22, 2021 (JP) ..... 2021-072939

(51) Int. Cl.

| | |
|---|---|
| ***G03G 15/16*** | (2006.01) |
| ***G03G 15/01*** | (2006.01) |
| ***G03G 21/16*** | (2006.01) |
| ***G03G 15/00*** | (2006.01) |

(52) U.S. Cl.

CPC ..... *G03G 15/1665* (2013.01); *G03G 15/0131* (2013.01); *G03G 15/1675* (2013.01); *G03G 15/5054* (2013.01); *G03G 21/168* (2013.01)

(58) Field of Classification Search

CPC ..... G03G 15/0131; G03G 15/1665; G03G 15/1675; G03G 15/5054; G03G 21/168

See application file for complete search history.

(56) References Cited

U.S. PATENT DOCUMENTS

| | | | | |
|---|---|---|---|---|
| 7,840,148 | B2 | 11/2010 | Tanaka et al. | |
| 2010/0142985 | A1* | 6/2010 | Minbe | G03G 15/163 399/314 |
| 2018/0004149 | A1* | 1/2018 | Ohno | G03G 15/2039 |
| 2019/0004456 | A1* | 1/2019 | Okumura | G03G 15/104 |

FOREIGN PATENT DOCUMENTS

| | | | |
|---|---|---|---|
| JP | 2001-083758 | A | 3/2001 |
| JP | 2004-118019 | A | 4/2004 |
| JP | 2007-225807 | A | 9/2007 |
| JP | 2014-109650 | A | 6/2014 |

* cited by examiner

*Primary Examiner* — Joseph S Wong
(74) *Attorney, Agent, or Firm* — Venable LLP

(57) ABSTRACT

An image forming apparatus includes an image bearing member, a transfer member, a moving portion, a driving portion, a voltage applying portion, a first detecting portion, and a second detecting portion. On the basis of a detection result of the first detecting portion when a first test voltage is applied to the transfer member by the voltage applying portion, the second detecting portion sets a second test voltage. The second detecting portion detects a position of the transfer member on the basis of a detection result of a current value by the first detecting portion acquired when the second test voltage is applied to the transfer member by the voltage applying portion.

15 Claims, 18 Drawing Sheets

| | STATE A | STATE B | STATE C | STATE D |
|---|---|---|---|---|
| FIXING ROLLER | CONTACT POSITION (C. P.) | SEPARATED POSITION (S. P.) | C. P. | S. P. |
| SECONDARY TRANSFER ROLLER | C. P. | S. P. | C. P. (REDUCED PRESSURE POSITION) | S. P. |

Fig. 4

IMAGE FORMING APPARATUS

FIELD OF THE INVENTION AND RELATED ART

The present invention relates to an image forming apparatus, such as a copying machine, a printer, or a facsimile machine, of an electrophotographic type or an electrostatic recording type.

Conventionally, in the image forming apparatus of the electrophotographic type, a toner image formed on an image bearing member such as a photosensitive drum or an intermediary transfer belt is transferred onto a transfer(-receiving) material under application of a transfer voltage to a transfer member for forming a transfer portion in contact with the image bearing member. As the transfer member, a transfer roller or the like including an elastic layer formed on a core metal by an elastic member is used.

In such an image forming apparatus, when the image forming apparatus is left standing while maintaining the transfer member in a contact state (long-term storage), by pressure (contact pressure) exerted on a contact portion, local deformation occurs in the transfer member and the image bearing member in some instances. Further, depending on a degree of the deformation, there is a possibility that the deformation causes an image defect due to improper transfer. Therefore, the image forming apparatus is provided in some instances with a constitution (contact and separation mechanism) in which the transfer member is separated (spaced) from the image bearing member or is reduced in contact pressure.

In the case where the contact and separation mechanism as described above is employed, a mechanism for detecting a position (contact state) of the transfer member is needed. Japanese Laid-Open Patent Application 2001-83758 discloses a constitution for detecting the position of the transfer member by detecting a current value of a current flowing through the transfer member.

However, in the constitution for detecting the position of the transfer member by detecting the current value of the current flowing through the transfer member, in the case where an electric resistance value changes, the current value of the current flowing through the transfer member changes, so that there is a possibility that the position of the transfer member is erroneously detected.

In a condition such that the electric resistance value of the transfer member is high, the current does not readily flow through the transfer member. For that reason, when a voltage value of a voltage applied to the transfer member is small, there is a possibility that in the case where the transfer member contacts the image bearing member, erroneous detection such that the transfer member is separated from the image bearing member is made. Accordingly, in the condition such that the electric resistance value of the transfer member is high, there is a need that the voltage value of the voltage applied to the transfer member is made high. On the other hand, in a condition such that the electric resistance value is low, the current readily flows through the transfer member. For that reason, when the voltage value of the voltage applied to the transfer member is high, in the case where the transfer member contacts the image bearing member, there is a possibility that excessive current flows. Further, even in the case where such an excessive current flows, it would be considered that countermeasures are taken so that there is no influence thereof on a current detecting circuit, the transfer member, and the like. Accordingly, in the condition such that the electric resistance value is low, there is a need to lower the voltage value of the voltage applied to the transfer member.

Here, as a factor in which the electric resistance value of the transfer member changes, a manufacturing variation of the transfer member, an environmental condition (temperature and humidity), a degree of use of the transfer member, and the like are cited. For these factors, it would be considered that countermeasures for suppressing a variation in electric resistance value of the transfer member are taken, but there is a possibility that the countermeasures lead to an increase in cost due to a change in material of the transfer member.

SUMMARY OF THE INVENTION

A principal object of the present invention is to provide an image forming apparatus capable of detecting a position of a transfer member even in the case where an electric resistance value of the transfer member changes.

According to an aspect of the present invention, there is provided an image forming apparatus comprising: an image bearing member configured to bear a toner image; a transfer member configured to form a transfer portion where the toner image is transferred from the image bearing member onto a transfer material in contact with the image bearing member; a moving portion configured to move the transfer member, relative to the image bearing member, to a plurality of positions including a contact position where the transfer member is contacted to the image bearing member and a separated position where the transfer member is separated from the image bearing member; a driving portion configured to drive the moving portion; an applying portion configured to apply a voltage to the transfer member; a first detecting portion configured to detect at least one of a voltage applied to the transfer member by the applying portion and a current flowing through the transfer member when the voltage is applied to the transfer member by the applying portion; and a second detecting portion configured to detect a position of the transfer member, wherein on the basis of a detection result of the first detecting portion acquired when a first test voltage is applied to the transfer member by the applying portion, the second detecting portion sets a second test voltage, and wherein the second detecting portion detects the position of the transfer member on the basis of a detection result of a current value by the first detecting portion acquired when the second test voltage is applied to the transfer member by the applying portion.

Further features of the present invention will become apparent from the following description of exemplary embodiments with reference to the attached drawings.

Figure 3:
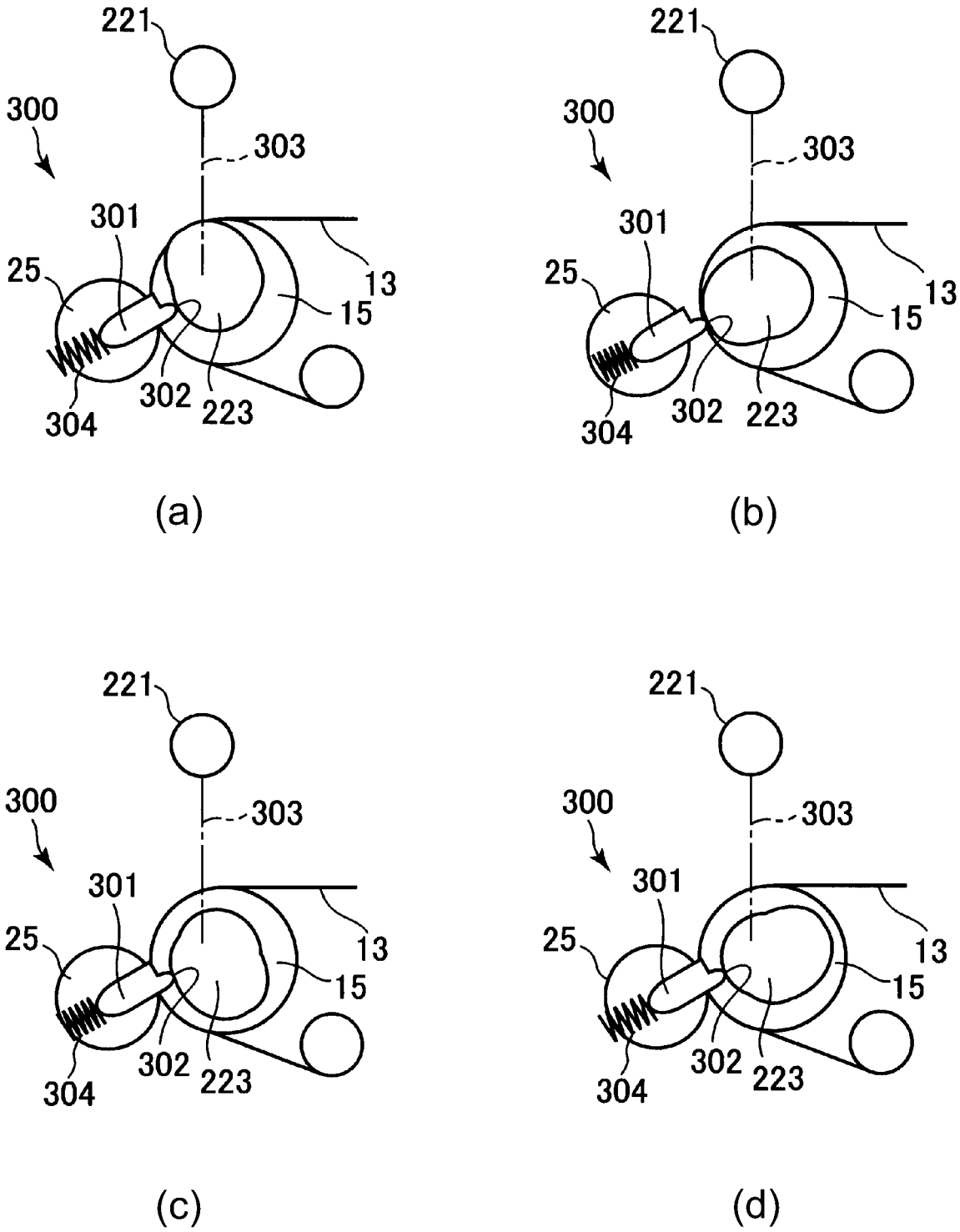

Parts (a) to (d) of FIG. 3 are schematic views for illustrating an operation of a secondary transfer contact and separation mechanism.

FIG. 4 is a table showing a relationship between a position of a fixing roller and a position of a secondary transfer roller.

Figure 5:
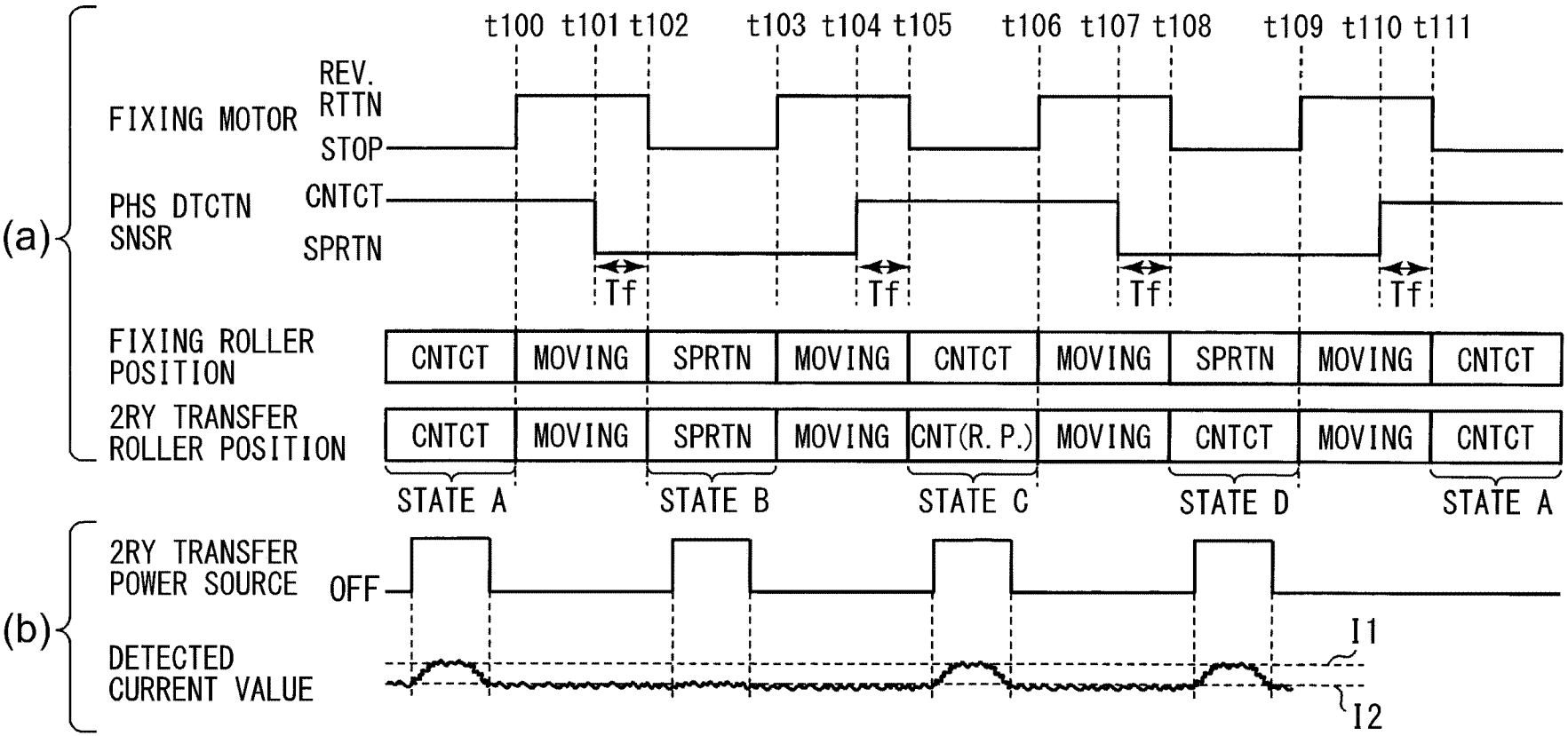

Parts (a) and (b) of FIG. 5 are timing charts for illustrating movement control of the secondary transfer roller.

Figure 6:
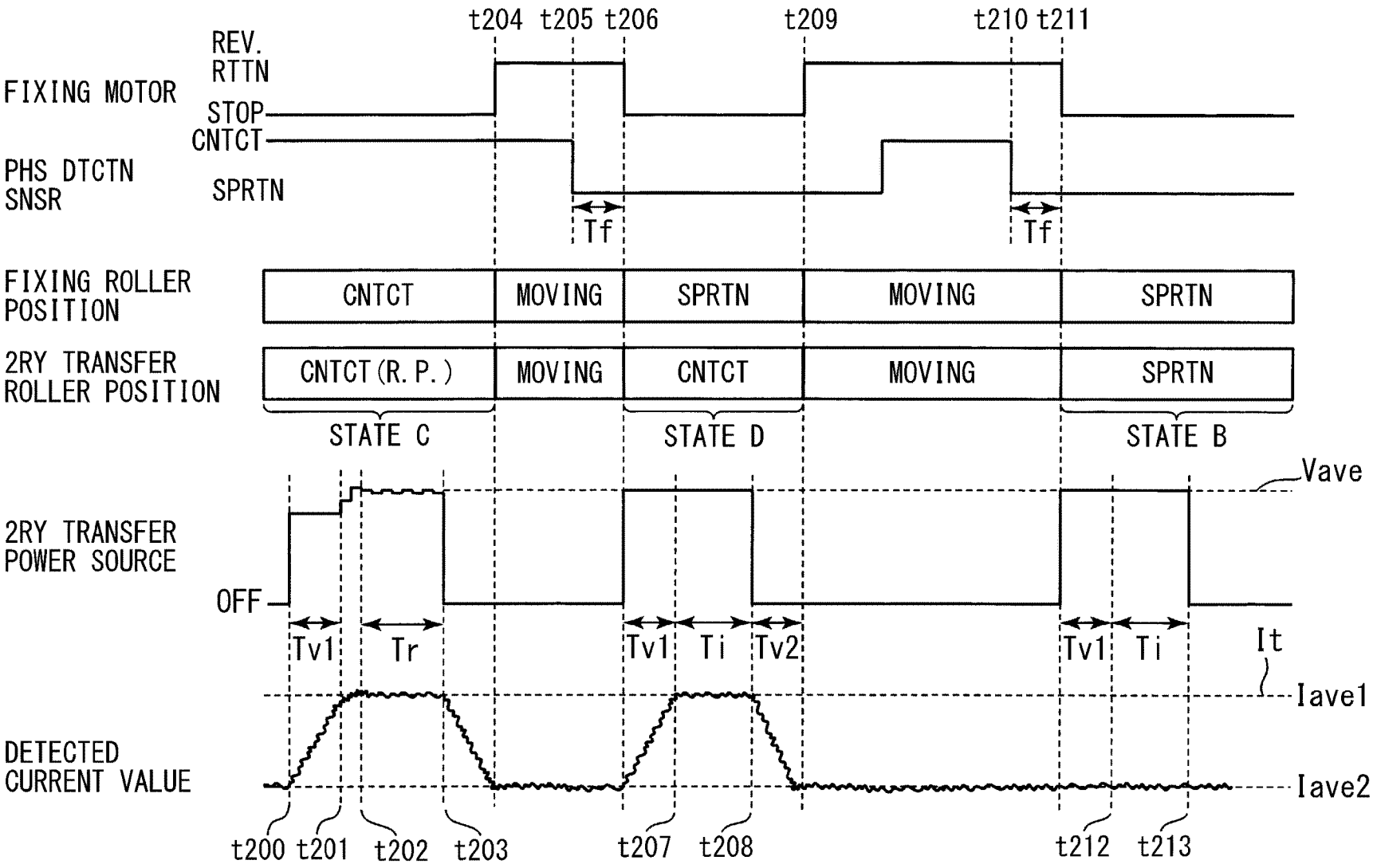

FIG. 6 is a timing chart for illustrating a position detecting operation in an embodiment 1.

Figure 7:
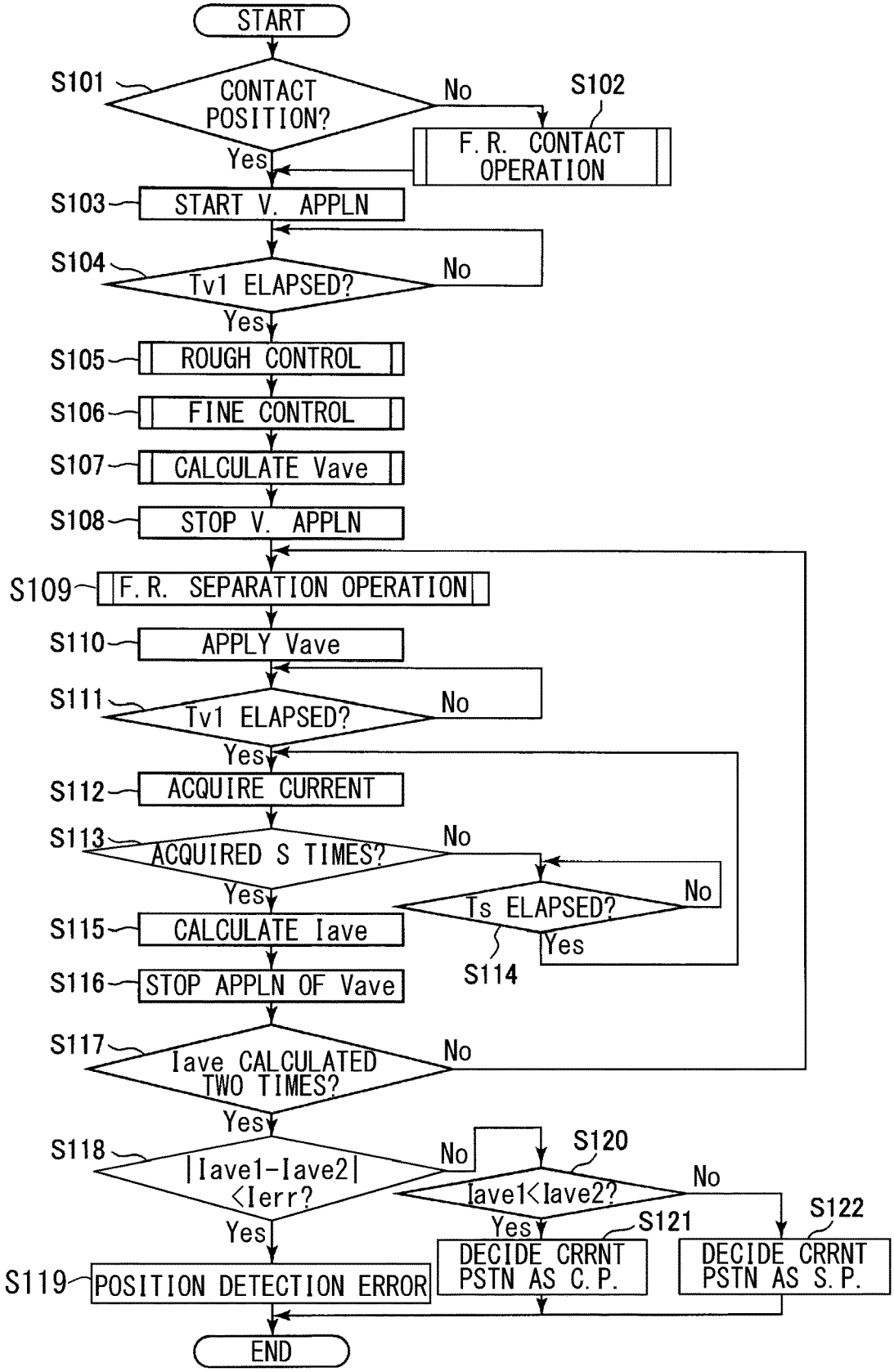

FIG. 7 is a flowchart of control in the embodiment 1.

Figure 8:
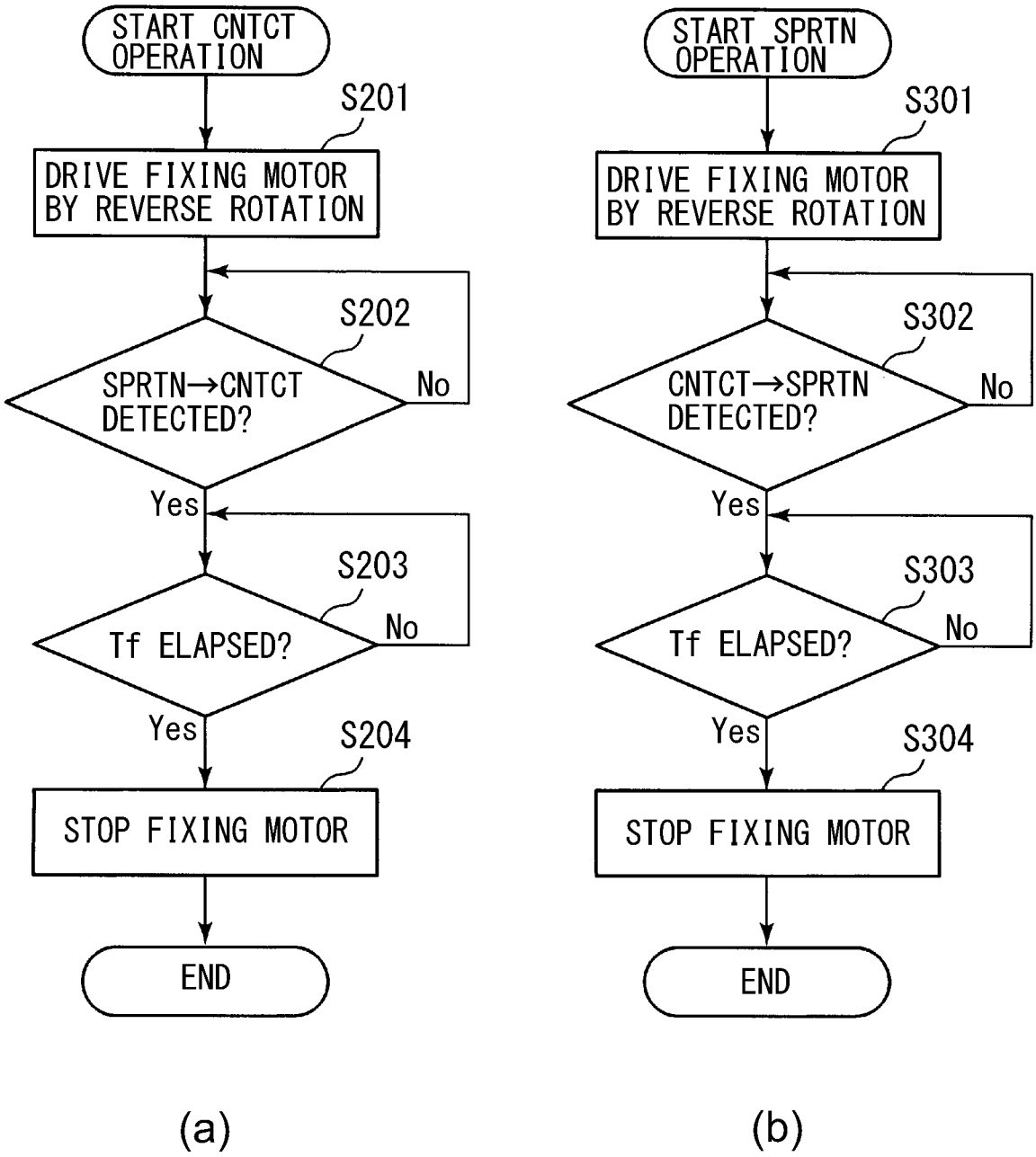

Parts (a) and (b) of FIG. 8 are flowcharts of the control in the embodiment 1.

Figure 9:
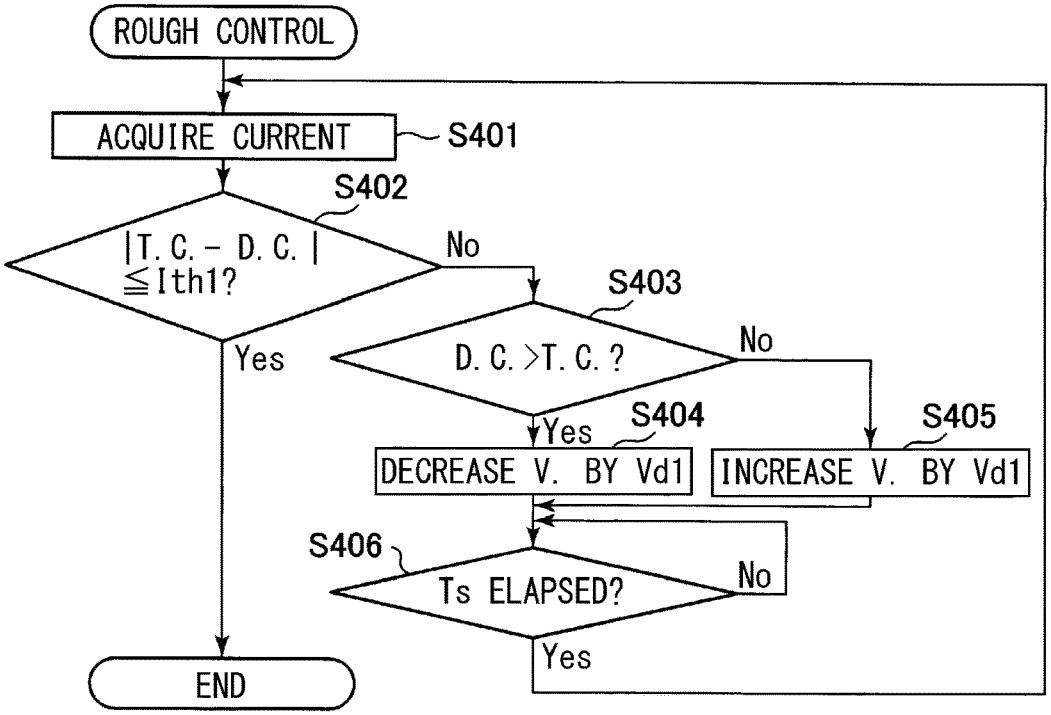
Figure 9:
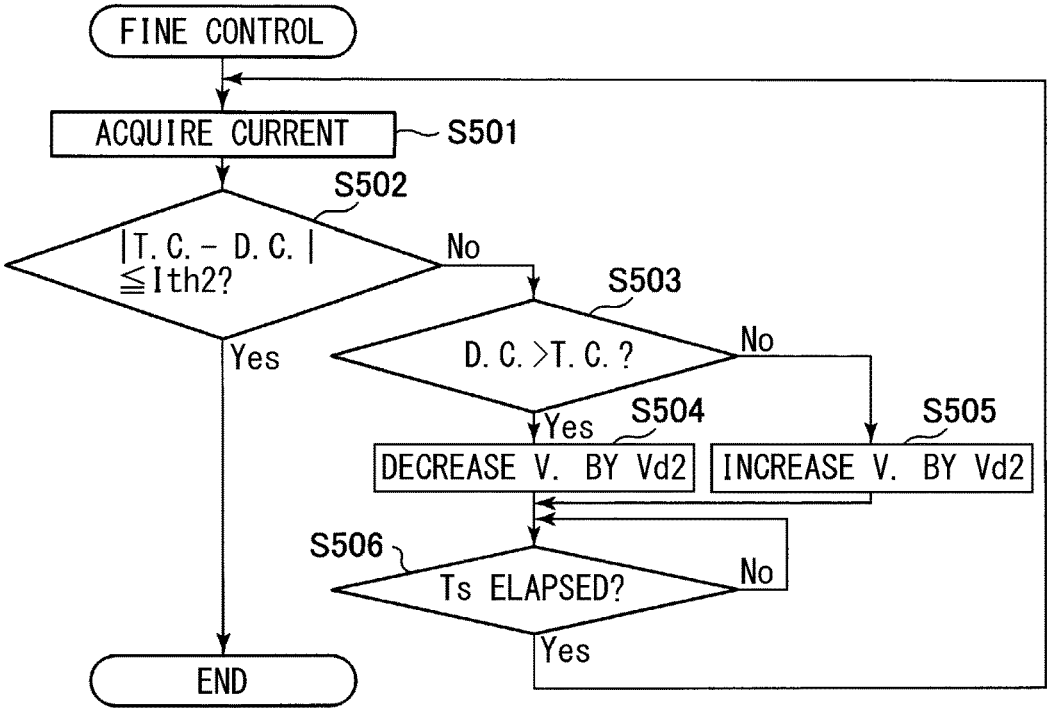

Parts (a) and (b) of FIG. 9 are flowcharts of the control in the embodiment 1.

Figure 10:
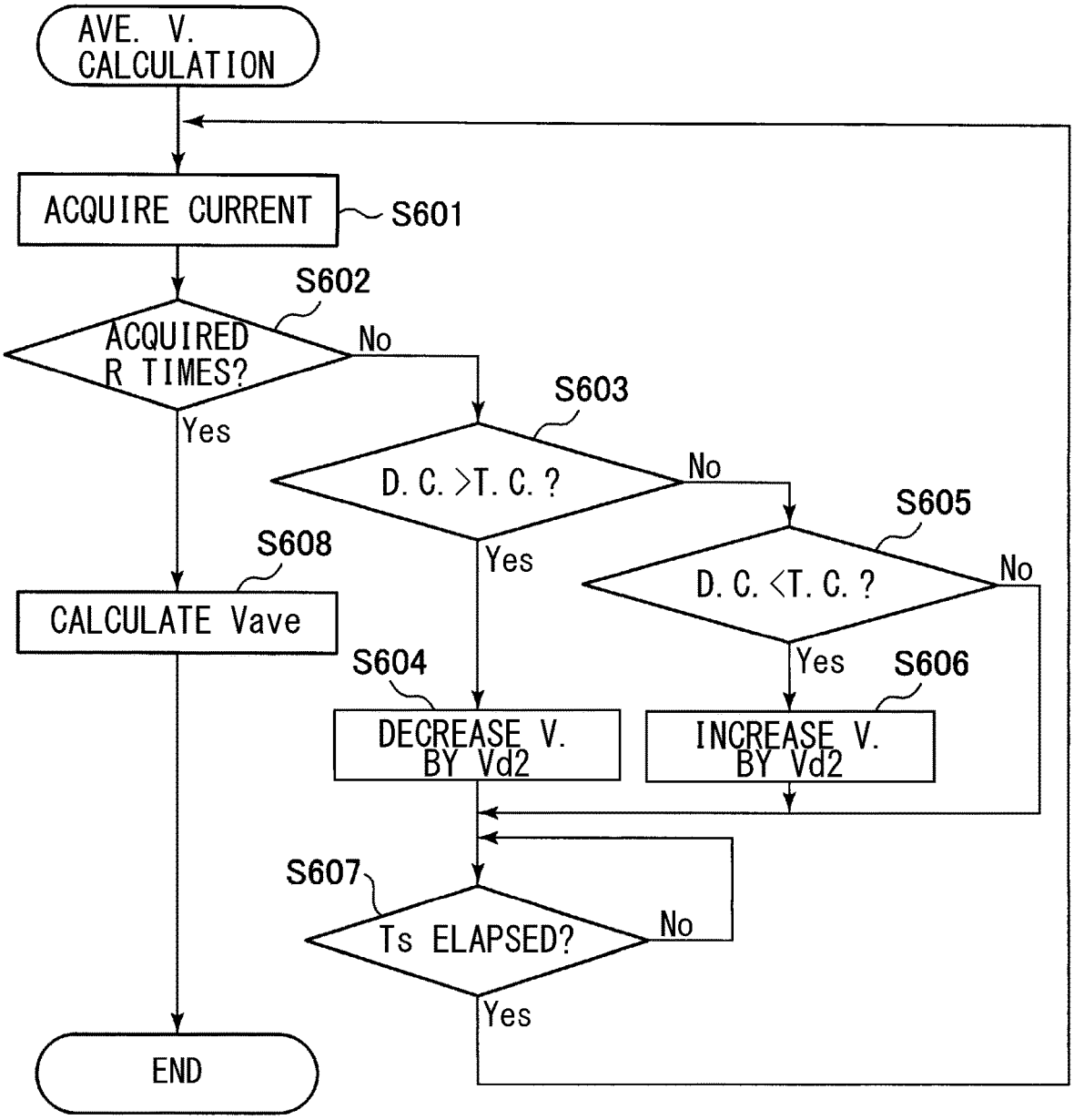

FIG. 10 is a flowchart of the control in the embodiment 1.

Figure 11:
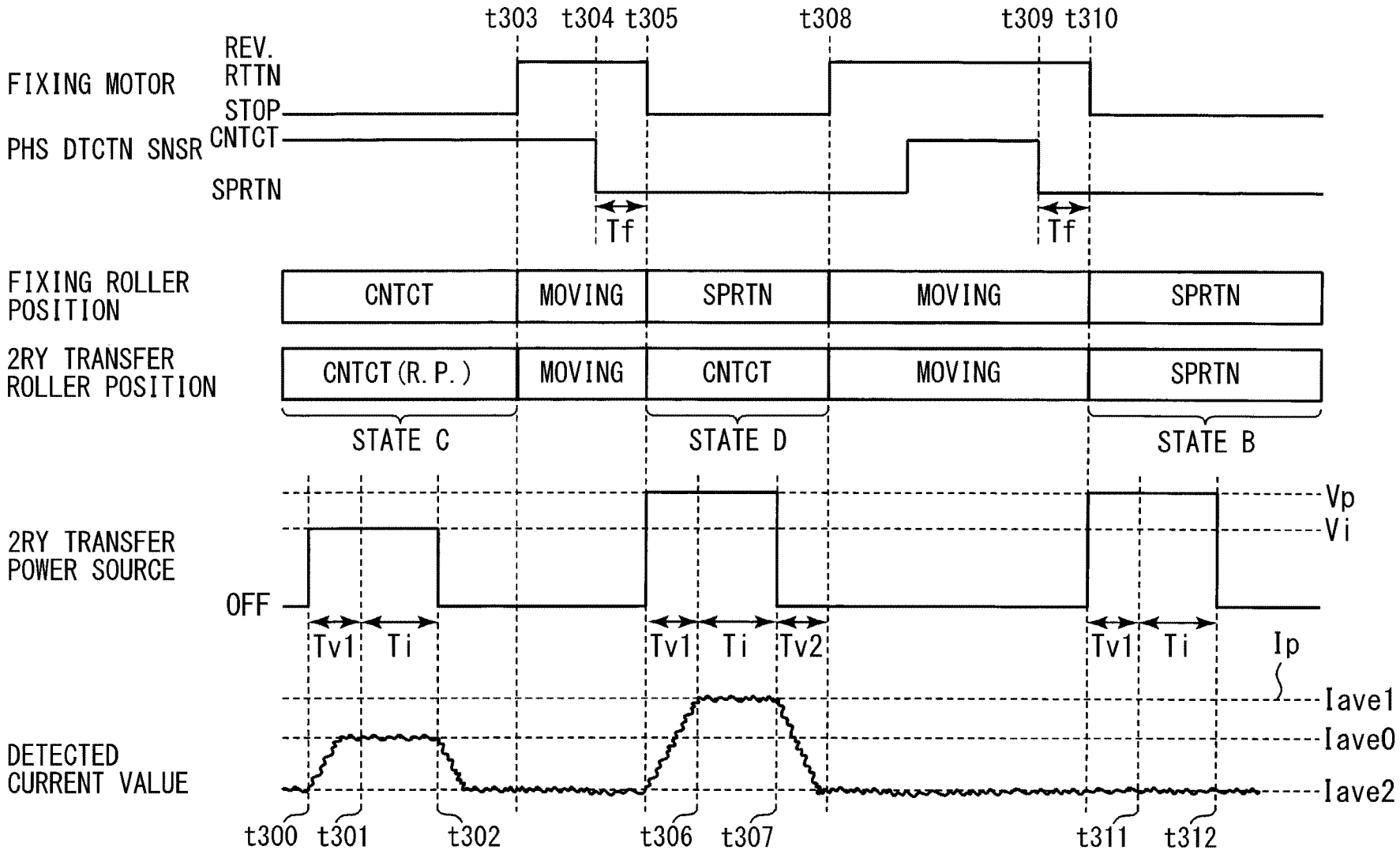

FIG. 11 is a timing chart for illustrating a position detecting operation in an embodiment 2.

Figure 12:
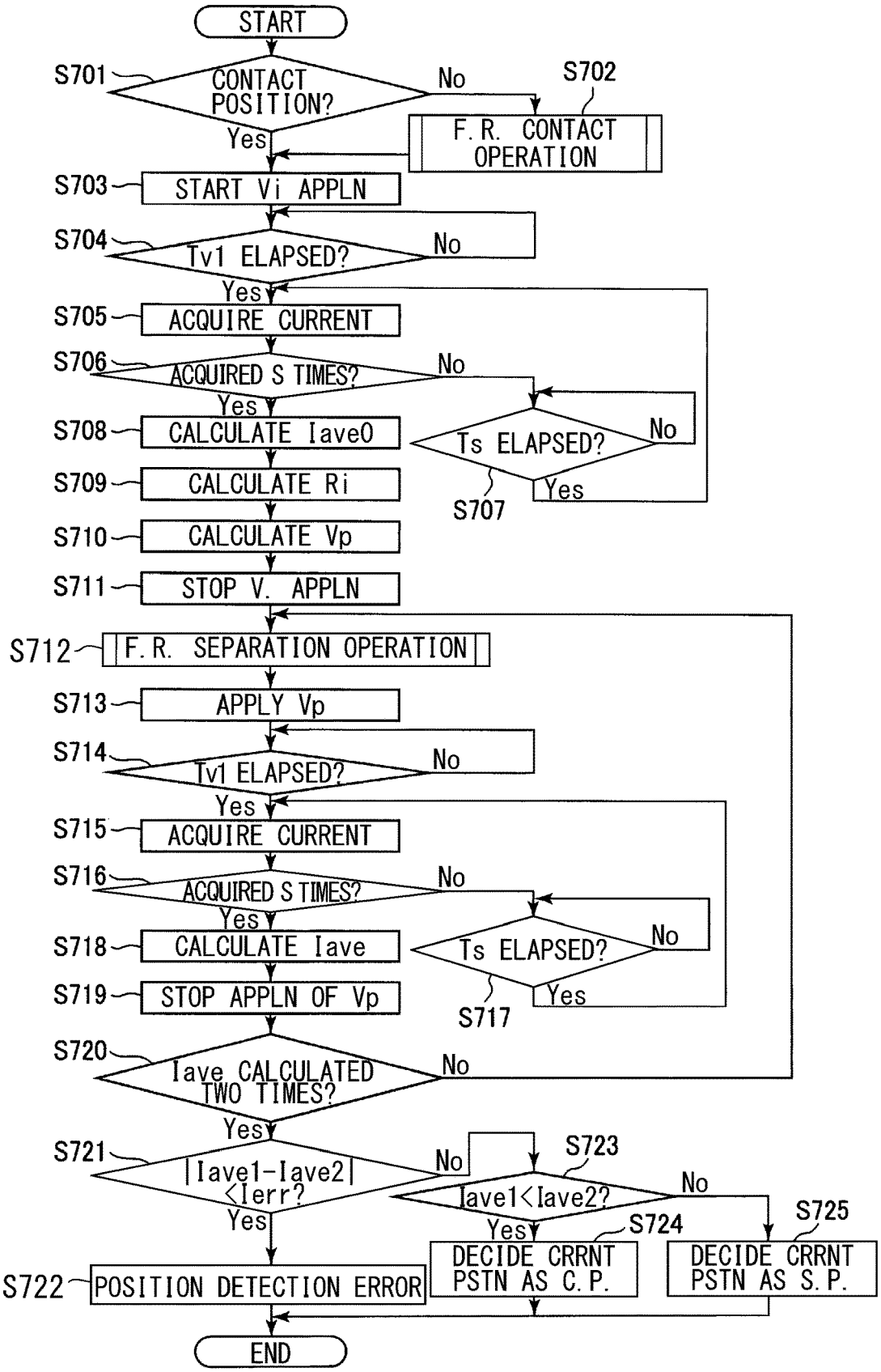

FIG. 12 is a flowchart of control in the embodiment 2.

Figure 13:
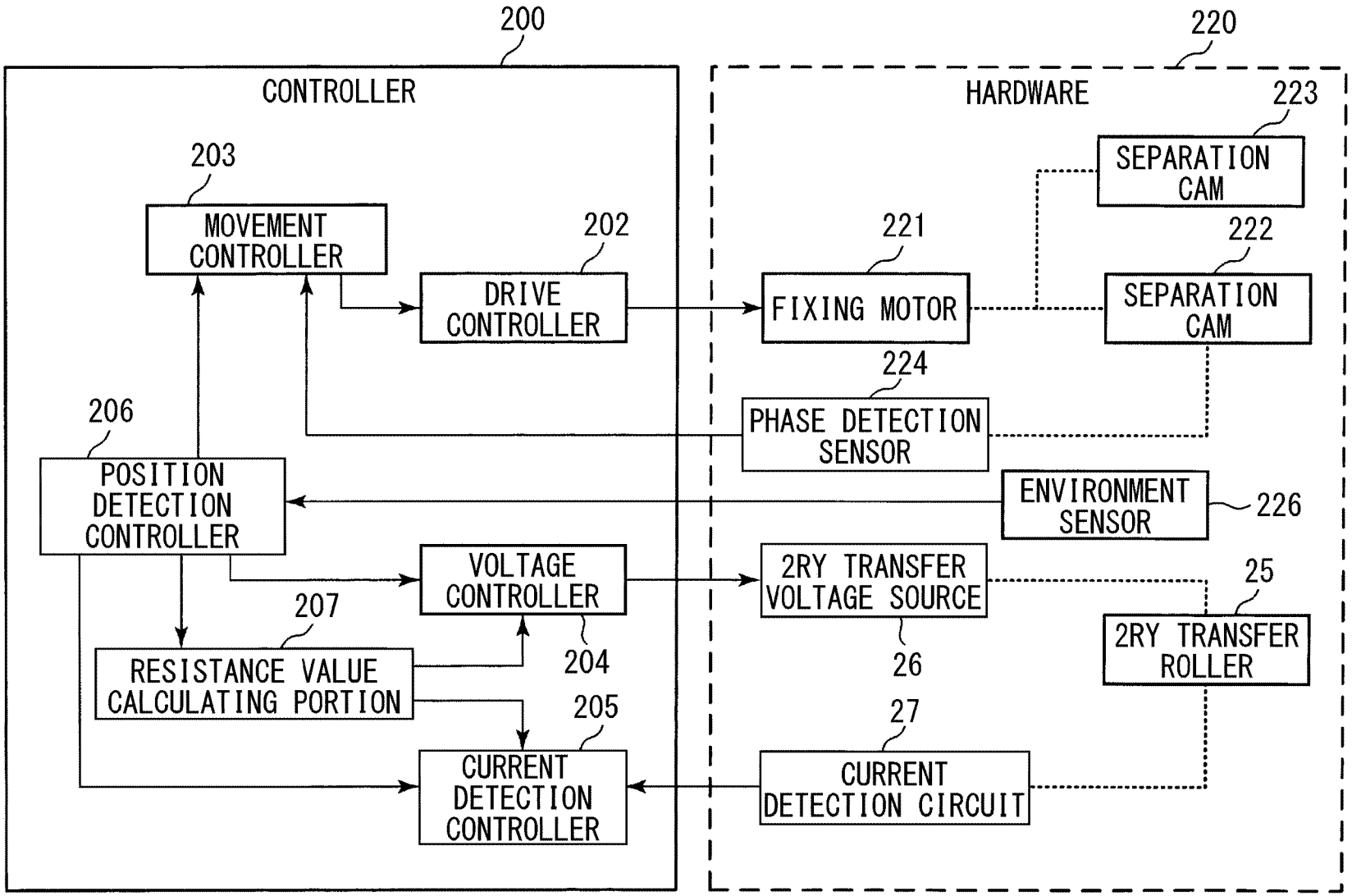

FIG. 13 is a block diagram showing another example of a control mode of the image forming apparatus.

Figure 14:
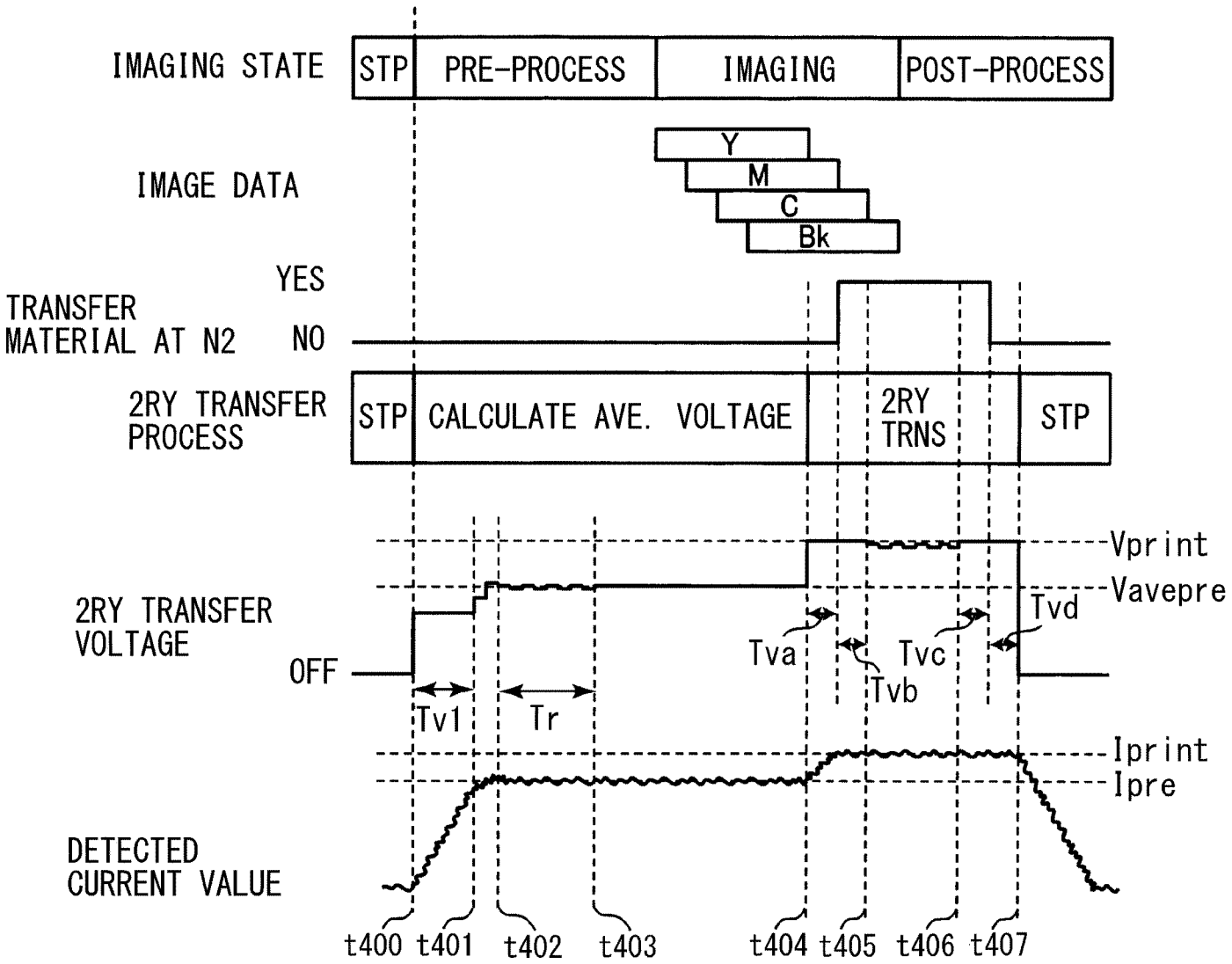

FIG. 14 is a timing chart for illustrating a calculating method of an electric resistance value of the secondary transfer roller.

Figure 15:
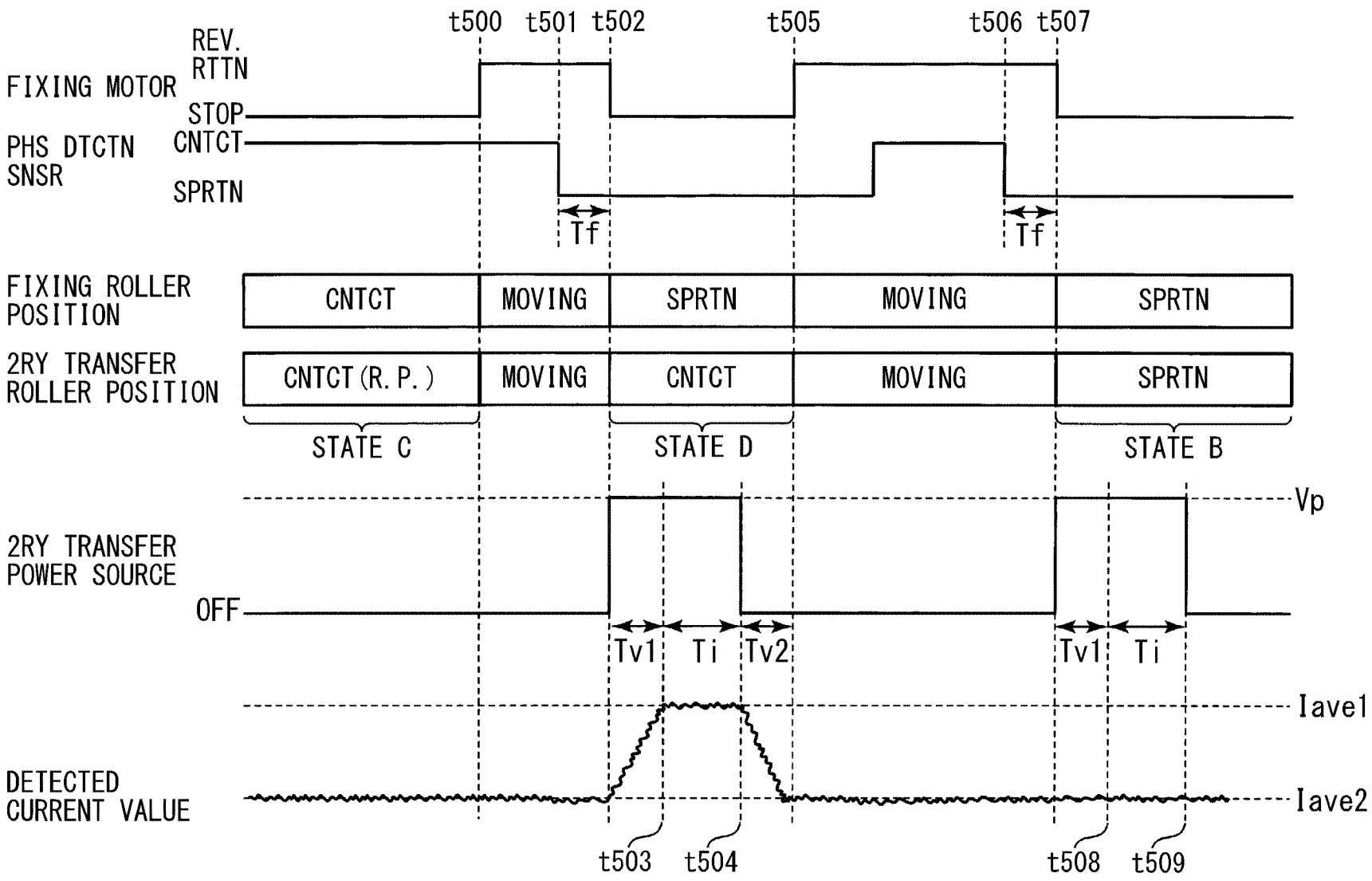

FIG. 15 is a timing chart for illustrating a position detecting operation in an embodiment 3.

Figure 16:
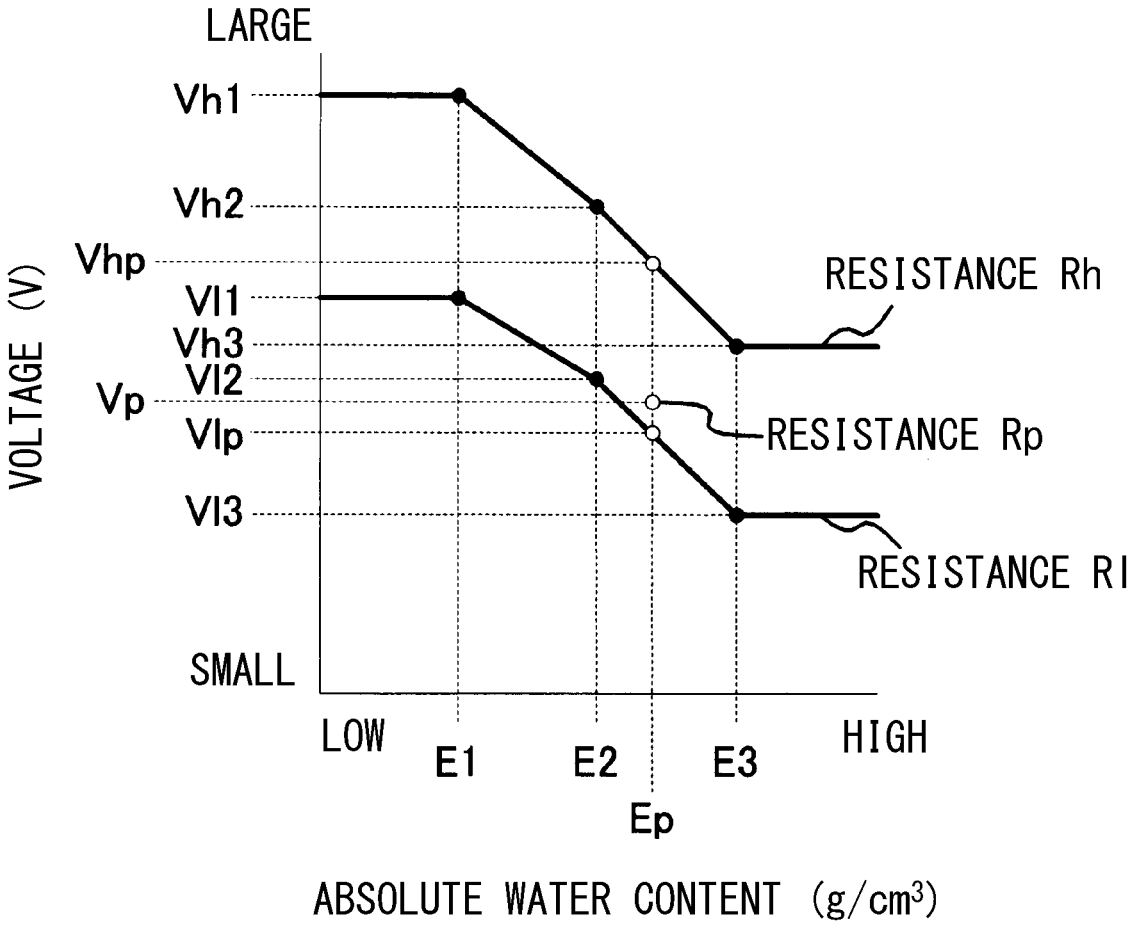

FIG. 16 is a graph for illustrating a determining method of a voltage value Vp in the embodiment 3.

Figure 17:
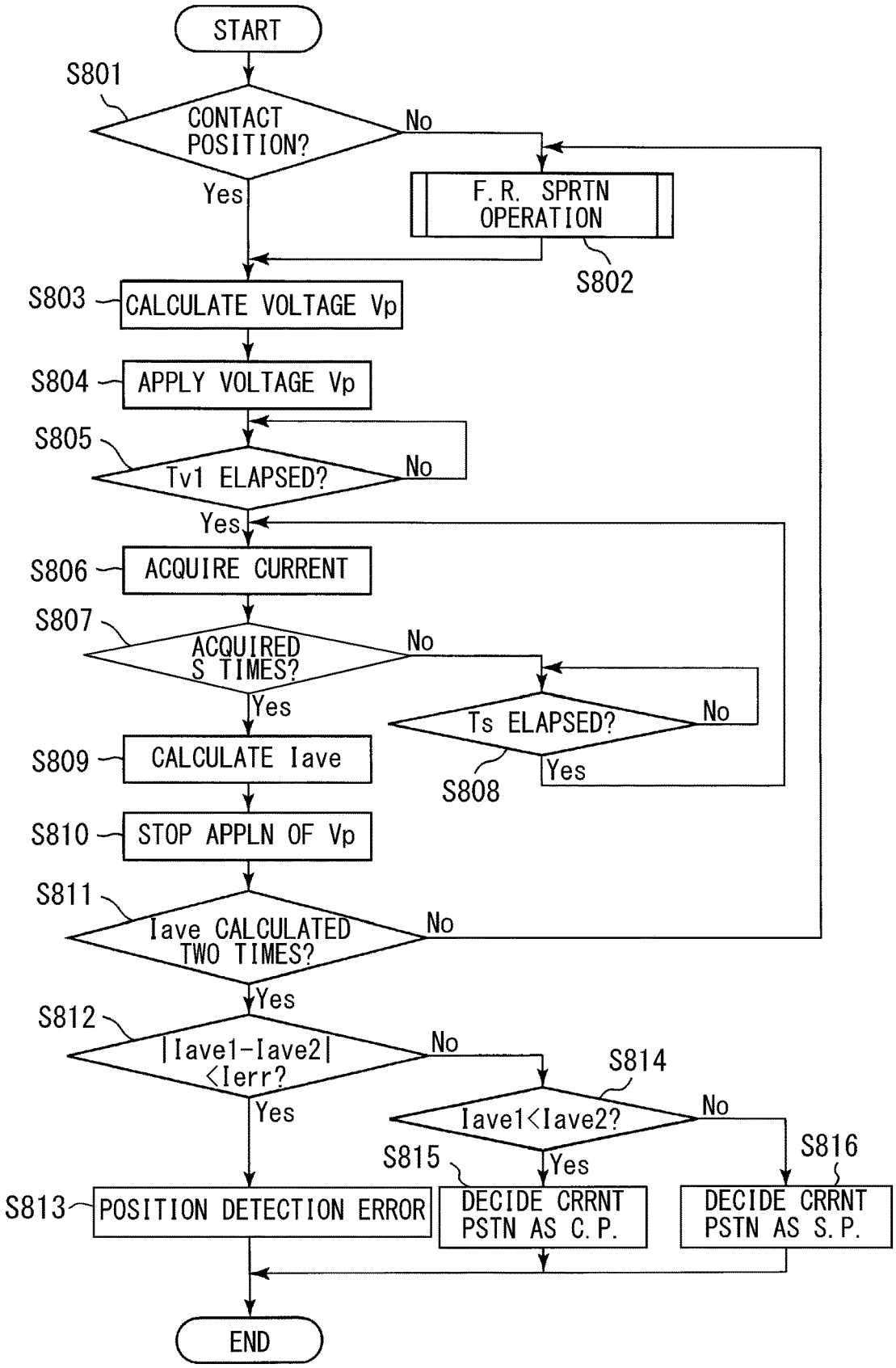

FIG. 17 is a flowchart of control in the embodiment 2.

Figure 18:
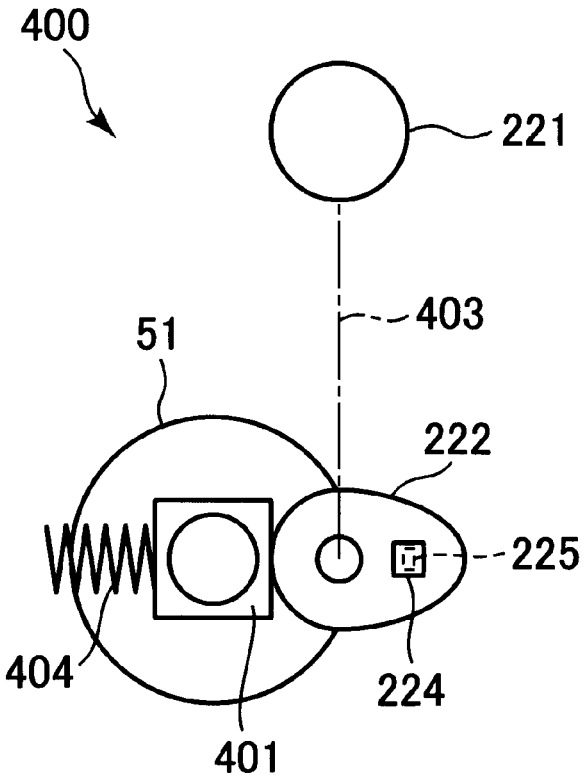

FIG. 18 is a schematic view for illustrating a fixing (means) contact and separation mechanism.

DESCRIPTION OF THE EMBODIMENTS

In the following, an image forming apparatus according to the present invention will be described specifically with reference to the drawings.

1. Structure and Operation of Image Forming Apparatus

Figure 1:
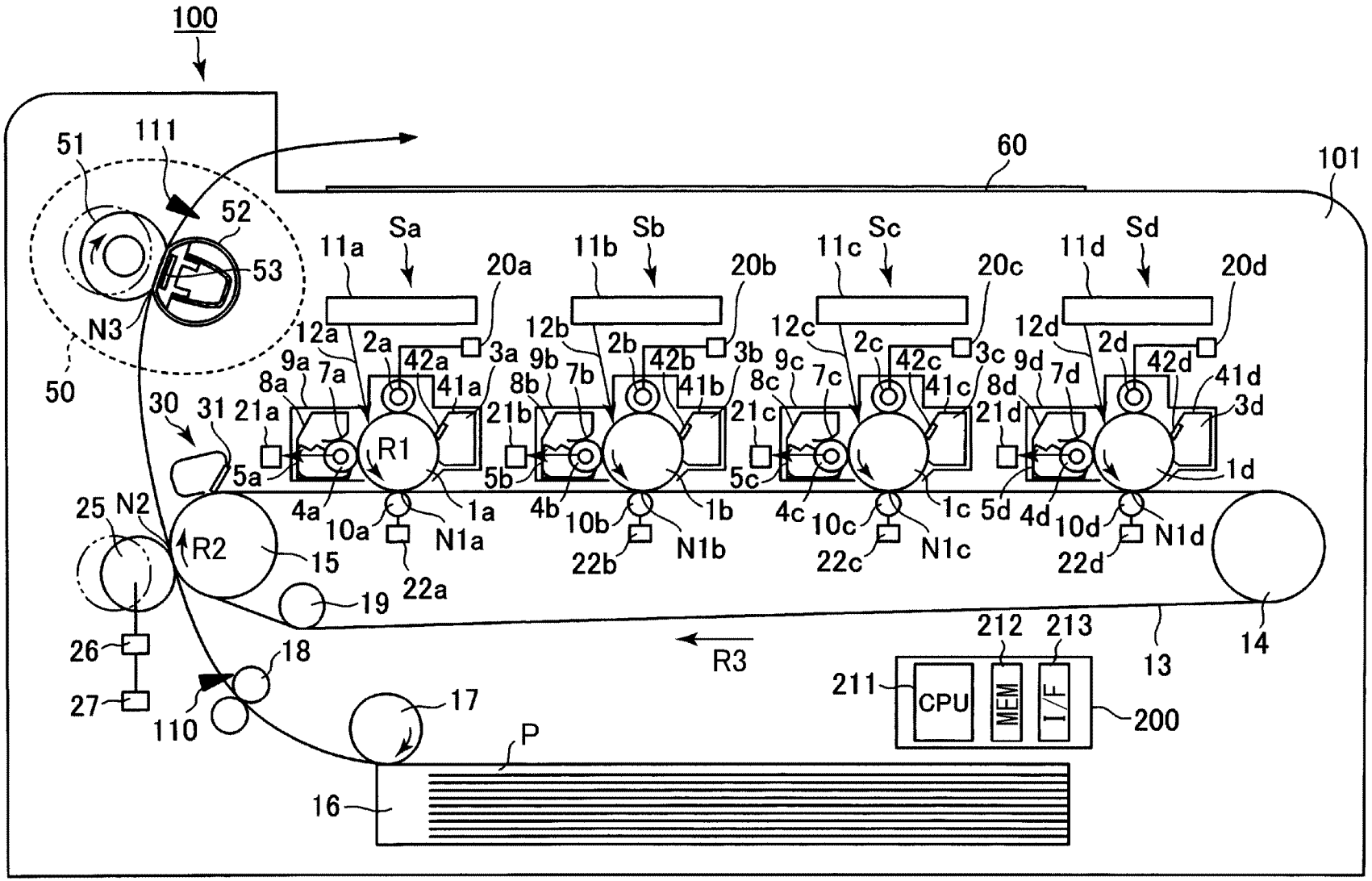
FIG. 1 is a schematic sectional view of an image forming apparatus.

First, a principal constitution of an image forming apparatus 100 of an embodiment 1 will be described. FIG. 1 is a schematic sectional view of the image forming apparatus 100 of the embodiment 1. The image forming apparatus 100 of this embodiment is a printer (color image forming apparatus) of a tandem type in which a full-color image is capable of being formed by using an electrophotographic type process and in which an intermediary transfer type system is employed.

The image forming apparatus 100 includes, as a plurality of image forming portions (stations), first to fourth image forming portions Sa, Sb, Sc and Sd for forming images with toners of colors of yellow (Y), magenta (M), cyan (C) and black (Bk), respectively. These four image forming portions Sa, Sb, Sc and Sd are disposed in line with substantially certain intervals along a movement direction of an intermediary transfer belt 13 on an image transfer side (described later). As regards elements having the same or corresponding functions or constitutions provided for the respective colors, these elements are collectively described in some instances by omitting suffixes a, b, c and d of reference numerals or symbols representing the elements for associated colors. In this embodiment, the image forming portion is constituted by including a photosensitive drum 1, a charging roller 2, an exposure device 11, a developing device 8, a primary transfer roller 10, a drum cleaning device 3, and the like, which are described later.

The image forming portion S includes the photosensitive drum 1 which is a rotatable drum type (cylindrical) photosensitive member (electrophotographic photosensitive member) as a first image bearing member. The photosensitive drum 1 is constituted by a plurality of lamination layers of functional organic materials including a carrier generating layer for generating carrier through sensitization, a charge transporting layer for transporting a generated charge, and the like. An outermost layer thereof is low in electrical conductivity and is almost electrically insulative. The photosensitive drum 1 is rotated at a predetermined peripheral speed (process speed) in an arrow R1 direction (counter-clockwise direction) in the figure by receiving a driving force from a driving source (not shown).

The charging roller 2 which is a roller type charging member as a charging means contacts the photosensitive drum 1 and is rotated by rotation of the photosensitive drum 1. A surface of the photosensitive drum 1 is electrically charged substantially uniformly by the charging roller 2 while being rotated. The charging roller 2 is connected to a charging power source 20 as a charging voltage applying portion. To the charging roller 2, a DC voltage as a charging voltage (charging bias) is applied from the charging power source 20. By this, the charging roller 20 charges the surface of the photosensitive drum 1 by electric discharge generating in at least one of minute air gaps formed on an upstream side and a downstream side of a contact portion between the charging roller 2 and the photosensitive drum 1 with respect to a rotational direction of the photosensitive drum 1.

The exposure device 11 as an exposure means is constituted by a scanner unit for scanning the photosensitive drum surface with laser light by a polygonal mirror. The exposure device 11 radiates the photosensitive drum 1 with a scanning beam 12 modulated on the basis of the image signal.

The developing device 8 as a developing means includes a developer container 5, a developing roller 4 as a developing member, and a developer applying blade 7 as a developer regulating member, and accommodates the toner as the developer inside the developer container 5. The developing roller 4 is connected to a developing power source 21 as a developing voltage applying portion. To the developing roller 4, from the developing power source 21, a superimposed alternating voltage including a DC voltage and an AC voltage is applied as a developing voltage (developing bias).

The cleaning device 3 as a cleaning means includes a cleaning blade 41 as a cleaning member contacting the photosensitive drum 1, and a cleaning container 42 for accommodating the toner removed from the photosensitive drum 1 by the cleaning blade 41. The cleaning device 3 collects the toner remaining on the photosensitive drum 1.

Incidentally, the photosensitive drum 1, and as process means actable on the photosensitive drum 1, the charging roller 2, the developing device 8, and the cleaning device 3 integrally constitute a process cartridge mountable in and dismountable from an apparatus main assembly 101 of the image forming apparatus 100.

An intermediary transfer belt 13 which is an intermediary transfer member constituted by an endless belt as a second image bearing member is provided so as to oppose the four photosensitive drums of the respective image forming portions S. The intermediary transfer belt 13 is stretched by three stretching rollers consisting of a secondary transfer opposite roller 15, a tension roller 14, and an auxiliary roller 19. The tension roller 14 is urged by a spring (not shown) which is an urging member as an urging means so as to maintain appropriate tension of the intermediary transfer belt 13. The opposite roller 15 is rotated in an arrow R2 direction (clockwise direction) in FIG. 1 by receiving a driving force from a driving source (not shown). The intermediary transfer belt 13 is rotated (circulated and moved) in an arrow R3 direction (clockwise direction) in FIG. 1 with rotation of the opposite roller 15. The intermediary transfer belt 13 is movable at the substantially same speed as the photosensitive drum 1 in the same direction at an opposing portion to the photosensitive drum 1. The auxiliary roller 19, the tension roller 14, and the opposite roller 15 are electrically grounded (connected to the ground). Incidentally, the opposite roller 15 is a roller constituted by coating a core metal (base portion) formed of an aluminum material with a 0.5 mm-thick elastic layer (elastic portion) formed of an EPDM rubber at a periphery of the core metal, and is 24.0 mm in outer diameter. In the opposite roller 15, carbon black is dispersed in the EPDM rubber so that an electric resistance value becomes about $1\times10^5\Omega$ and thus the electric resistance value is adjusted.

On an inner peripheral surface side of the intermediary transfer belt 13, the primary transfer rollers 10*a*, 10*b*, 10*c* and 10*d* which are roller-shaped primary transfer members as primary transfer means are provided correspondingly to the photosensitive drums 1*a*, 1*b*, 1*c* and 1*d*, respectively. Each of the primary transfer rollers 10 is disposed at a position opposing the photosensitive drum 1 via the intermediary transfer belt 13 and contacts the inner peripheral surface of the intermediary transfer belt 13, and is rotated with movement of the intermediary transfer belt 13. The primary transfer roller 10 is contacted to the photosensitive drum 1 via the intermediary transfer belt 13 and is urged toward the photosensitive drum 1, and thus forms a primary transfer portion (primary transfer nip) N1 where the photosensitive drum 1 and the intermediary transfer belt 13 are in contact with each other. The primary transfer roller 10 is connected to a primary transfer power source 22. Incidentally, the primary transfer roller 10 is constituted by coating an elastic layer (elastic portion) formed of a foamed elastic member so as to have an outer diameter of 14 mm around a core metal (base portion) formed of a nickel-plated steel rod of 5 mm in outer diameter. In the primary transfer roller 10, an electroconductive agent is contained in a material of the formed elastic member so as to provide an electric resistance value at about $1\times10^6\Omega$, and thus the electric resistance value is adjusted. It is preferable that the electric resistance value of the primary transfer roller 10 falls within a range of $10^3$ to $10^7\Omega$ from the viewpoint of carrying out good image formation.

On an outer peripheral surface side of the intermediary transfer belt 13, at a position opposing the opposite roller 15, a secondary transfer roller 25 which is a roller-shaped secondary transfer member, is provided. The secondary transfer roller 25 is capable of being contacted to and separated from the outer peripheral surface of the intermediary transfer belt 13. The secondary transfer roller 25 is disposed at the position opposing the opposite roller 15 via the intermediary transfer belt 13 and is contacted to the outer peripheral surface of the intermediary transfer belt 13, and thus is rotated with movement of the intermediary transfer belt 13. The secondary transfer roller 25 is contacted to the opposite roller 25 and is urged toward the opposite roller 15, and thus forms a secondary transfer portion (secondary transfer nip) N2 where the intermediary transfer belt 13 and the secondary transfer roller 25 are in contact with each other. The secondary transfer roller 25 is connected to a secondary transfer power source 26 as a secondary transfer voltage applying portion. Further, the secondary transfer power source 26 is connected to a current detecting circuit 27 as a detecting portion (first detecting portion). The secondary transfer power source 26 applies a voltage to the secondary transfer roller 25, and the current detecting circuit 27 is capable of detecting a current value of a current flowing through the secondary transfer roller 25. Incidentally, the secondary transfer roller 25 is constituted by coating an elastic layer (elastic portion) formed of a foamed elastic member around a core metal (base portion) made of metal.

A fixing device 50 as a fixing means includes a fixing roller (pressing roller) 51 and a cylindrical fixing film (fixing belt) 52. On an inner peripheral surface side of the fixing film 52, a heating member 53 for imparting heat to a transfer(-receiving) material P via the fixing film 52 is disposed. The fixing roller 51 is capable of being contacted to and separated (spaced) from an outer peripheral surface of the fixing film 52. The fixing roller 51 is contacted to the heating member 53 via the fixing film 52 and is urged toward the heating member 53, and thus forms a fixing portion (fixing nip) N3 where the fixing roller 51 and the fixing film 52 are in contact with each other. Further, the fixing roller 51 is rotated by receiving a driving force from a fixing motor 221 (FIG. 2) as a driving source, and the fixing film 52 is rotated with rotation of the fixing roller 51.

Further, the image forming apparatus 100 is provided with a control portion (control board, controller) 200 on which an electric circuit for controlling respective portions of the image forming apparatus 100 is mounted. On the controller 200, a CPU 211 as a control means, a memory 212 as a storing means in which various pieces of control information are stored, and an input/output portion (I/F) 213 for controlling transfer of signals between the controller 200 and the respective portions. The CPU 200 executes control relating to feeding of the transfer material P, control relating to drive of the image forming portion S and the intermediary transfer belt 13, control relating to image formation, control relating to failure detection, and the like control. The memory 212 is constituted by reducing a ROM (including a rewritable ROM) and a RAM. In the ROM, a program and a data table which relate to the control are stored, and in the RAM, data showing detection results of various sensors and a calculation result relating to the control are stored.

2. Image Forming Operation

Next, an image forming operation of the image forming apparatus 100 will be described. The controller 200 starts an image forming operation when receives an image signal from an external device (not shown) such as a personal computer, for example. When the image forming operation is started, the respective photosensitive drums 1 and the opposite roller 15 and the like start rotation at a predetermined peripheral speed (process speed) by a driving force from the driving source (not shown). In the embodiment 1, the process speed is 200 mm/sec.

The rotating surface of the photosensitive drum 1 is charged uniformly by the charging roller 2. During a charging step, to the charging roller 2, a charging voltage which is a DC voltage of the same polarity (negative in this embodiment) as a normal charge polarity of the toner. The charged surface of the photosensitive drum 1 is subjected to scanning exposure with the scanning beam 12 depending on image information of a color component corresponding to the associated image forming portion S by the exposure device 11, so that an electrostatic latent image (electrostatic image) depending on the image information is formed on the photosensitive drum 1. The electrostatic latent image formed on the photosensitive drum 1 is developed (visualized) by being supplied with the toner as a developer by the developing device 8, so that a toner image (developer image) is formed on the photosensitive drum 1. In the developing device 8, the toner accommodated in the developing container 5 is negatively charged by the developer applying blade 7 and is applied onto the developing roller 4. Further, during a developing step, a developing voltage of the same polarity (negative in this embodiment) as the normal charge polarity of the toner is applied from the developing power source 21. By this, the toner is moved from the developing roller 4 and is deposited on an image portion of the electrostatic latent image on the photosensitive drum 1 at a developing portion where the developing roller 4 and the photosensitive drum 1 are in contact with each other. In the embodiment 1, on an exposure portion (image portion) of the photosensitive drum 1 where an absolute value of a potential is lowered through exposure to light after the uniform charging process, the toner charged to the same polarity (negative in this embodiment) as the normal charge polarity of the photosensitive drum 1 is deposited (reverse development). In this embodiment, the normal charge polarity of the toner which is the charge polarity of the toner during the development is the negative polarity.

The toner image formed on the photosensitive drum 1 is transferred (primary-transferred) onto the rotating intermediary transfer belt 13 by the action of the primary transfer roller 10 in the primary transfer nip N1. During a primary transfer step, to the primary transfer roller 10, a primary transfer voltage (primary transfer bias) which is a DC voltage of a polarity (positive in this embodiment) opposite to the normal charge polarity of the toner is applied from a primary transfer power source 22. For example, during full-color image formation, toner images of yellow, magenta, cyan and black formed on the respective photosensitive drums are successively primary-transferred superposedly onto the intermediary transfer belt 13. By this, on the intermediary transfer belt 13, a four color-based toner image corresponding to an objective color image is formed.

The toner image formed on the intermediary transfer belt 13 is transferred (secondary-transferred) onto the transfer material P fed while being nipped between the intermediary transfer belt 13 and the secondary transfer roller 25 by the action of the secondary transfer roller 25 in the secondary transfer portion N2. During a secondary transfer step, to the secondary transfer roller 25, a secondary transfer voltage (secondary transfer bias) which is a DC voltage of the polarity (positive in this embodiment) opposite to the normal charge polarity of the toner is applied from a secondary transfer power source 26. The transfer materials P (recording medium, recording material, sheet, form) such as paper and OHP sheet are accommodated in a transfer material cassette 16. The transfer material P is fed from the transfer material cassette 16 to a conveying roller pair 18 by a feeding roller 17 and thereafter is fed (conveyed) toward the secondary transfer portion N2 by the conveying roller pair 18.

The transfer material P on which the toner image is transferred is conveyed toward the fixing device 50 by the secondary transfer roller 25 and the opposite roller 15. The fixing device 50 heats and presses the transfer material P in the fixing nip N3. The unfixed toner image carried on the transfer material P fixed (melted, stack) in a process in which the transfer material P passes through the fixing nip N3. For example, during the full-color image formation, the toners of the four colors are melted and mixed in the fixing nip N3 and are fixed on the transfer material P. Thereafter, the transfer material P is discharged (outputted) to an outside of the apparatus main assembly 101 of the image forming apparatus 100 and is stacked on a discharge tray 60 as a stacking portion provided at an upper portion of the apparatus main assembly 101.

Incidentally, in the image forming apparatus 100, as sensors for detecting the transfer material P during the above-described image forming operation, a registration sensor 110, a discharging sensor 111, and the like are provided.

On the other hand, toner (primary transfer residual toner) remaining on the photosensitive drum 1 after the primary transfer is removed and collected from the surface of the photosensitive drum 1 by the cleaning device 3. Further, on an outer peripheral surface side of the intermediary transfer belt 13, at a position opposing the opposite roller 15 via the intermediary transfer belt 13, a belt cleaning device 30 as an intermediary transfer member cleaning means is provided. The toner (secondary transfer residual toner) remaining on the intermediary transfer belt 13 after the secondary transfer is removed and collected from the surface of the intermediary transfer belt 13 by the belt cleaning device 30. The belt cleaning device 30 is constituted by including a cleaning blade 31 contacting the outer peripheral surface of the intermediary transfer belt 13 at a position opposing the opposite roller 15.

3. Control Mode

Figure 2:
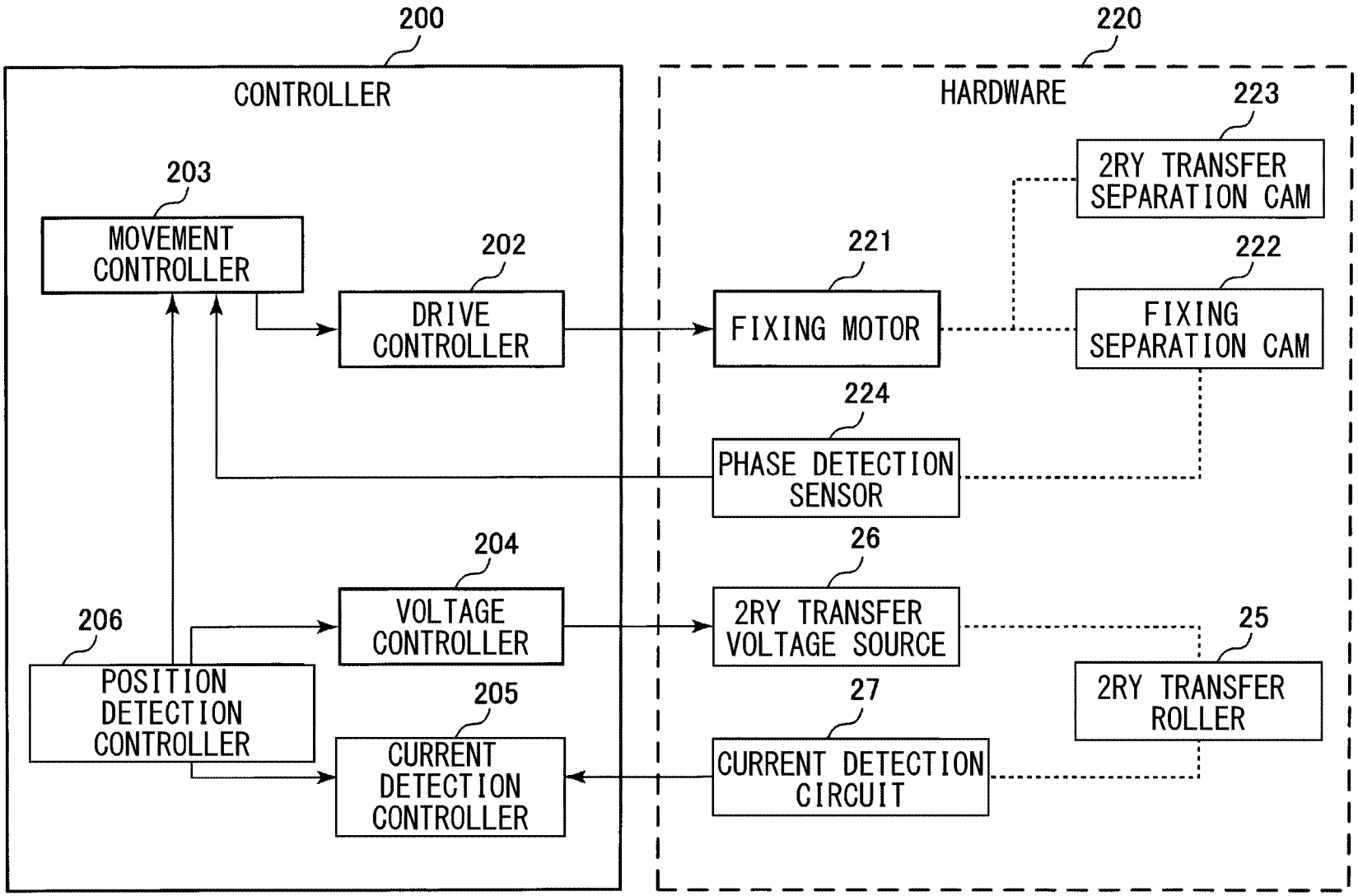
FIG. 2 is a block diagram showing a control mode of a principal part of the image forming apparatus.

FIG. 2 is a block diagram showing a control mode relating to detection (discrimination) of a position of the secondary transfer roller 25 in the image forming apparatus 100 of the embodiment 1. In FIG. 2, functional blocks in the controller 200 and a hardware 220 operable under control of the controller 200 are shown.

The controller 200 includes, as the functional blocks, a drive controller 202, a movement controller 203, a voltage controller 204, current detection controller 205, and a position detection controller 206. In the embodiment 1, the above-described functional blocks are realized by executing programs stored in the memory 212 (FIG. 1), by the CPU 211 (FIG. 1). Further, in the controller 200, the CPU 211 for realizing the above-described respective functional blocks principally controls an operation (including acquisition of a detection result) of the hardware 220 shown in FIG. 2 via the input/output portion 213 (FIG. 1), and thus executes a process relating to the detection of the position of the secondary transfer roller 25. In the above-described hardware 220, a fixing motor 221, a fixing separation cam 222, a secondary transfer separation cam 223, a phase detecting sensor 224, the secondary transfer roller 25, the secondary transfer power source 26, and the current detecting circuit 27 are included.

The movement controller 203 operates the fixing separation cam 222 and the secondary transfer separation cam 223 by causing the drive controller 202 to drive the fixing motor 221, and thus causes the fixing roller 51 and the secondary transfer 25 to move. That is, the movement controller 203 changes a position of the fixing roller 51 relative to the fixing film 52 (or the heating member 53) and the position of the secondary transfer roller 25 relative to the intermediary transfer belt 13 (or the opposite roller 15). Further, the movement controller 203 detects a phase (position with respect to a rotational direction) of the fixing separation cam 222, i.e., the position of the fixing roller 51 by the action of the phase detecting sensor 224. The fixing separation cam 222 constitutes a fixing contact and separation mechanism 400 (FIG. 18) described later. Further, the secondary transfer separation cam 223 as a moving portion constitutes a secondary transfer contact and detection mechanism 300 (FIG. 2) described later.

The position detection controller 206 as a position detecting portion (second detecting portion) detects the position of the secondary transfer roller 25 by the actions of the voltage controller 204, the current detection controller 205, and the movement controller 203. That is, the position detecting portion 206 causes the movement controller 203 to move the secondary transfer roller 25 and causes the voltage controller 204 to apply the voltage from the secondary transfer power source 26 to the secondary transfer roller 25 as specifically described later. Then, the position detection controller 206 detects the position of the secondary transfer roller 25 on the basis of a detection result of a current value acquired from the current detection circuit 27 by the current detection controller 205 when the above-described voltage is applied to the secondary transfer roller 25.

Incidentally, in the embodiment 1, the secondary transfer power source 26 is capable of applying, to the secondary transfer roller 25, a voltage controlled so that the voltage becomes substantially constant at a voltage value set by the voltage controller 204 (constant-voltage control). The voltage controller 204 is capable of detecting (recognizing) a voltage value of the voltage applied from the secondary transfer power source 26 to the secondary transfer roller 25, by the voltage value set for the secondary transfer power source 26. That is, in the embodiment 1, the voltage controller 204 has a function of a voltage detecting portion for detecting the voltage value of the voltage applied to the secondary transfer roller 25. The current detection circuit 27 as a current detecting portion detects a current value of a current flowing through the secondary transfer roller 25 when the secondary transfer power source 26 applies the voltage to the secondary transfer roller 25. The current detection controller 205 acquires a detection result of the current value by the current detection circuit 27. In the embodiment 1, the secondary transfer power source 26 is capable of applying, to the secondary transfer roller 25, a voltage controlled so that the current value detected by the current detection circuit 27 becomes substantially constant (constant-current control).

4. Secondary Transfer Contact and Separation Mechanism

Next, the secondary transfer contact and separation mechanism 300 as a moving mechanism for moving the secondary transfer roller to a plurality of positions relative to the intermediary transfer belt 13 in the embodiment 1 will be described. Parts (a) to (d) of FIG. 3 are schematic views for illustrating an operation of the secondary transfer contact and separation mechanism 300. In each of parts (a) to (d) of FIG. 3, one end portion side of the secondary transfer roller 25 with respect to a rotational axis direction is shown, but the other end side of the secondary transfer roller 25 also has the same constitution as the constitution shown in the associated figure (i.e., these sides are substantially symmetrical with each other with respect to a center of the rotational axis direction of the secondary transfer roller 25).

In the embodiment 1, the secondary transfer contact and separation mechanism 300 is constituted by the secondary transfer separation cam 223, the fixing motor 221, and a bearing 301 for the secondary transfer roller 25 and the like. The secondary transfer separation cam 223 is rotatably provided at each of opposite end portions of the opposing roller 15 with respect to the rotational axis direction. The secondary transfer separation cam 223 is rotatable about a rotational axis coaxial with a rotational axis of the opposing roller 15. The bearing 301 for the secondary transfer roller 25 is provided at each of opposite end portions of the secondary transfer roller 25 with respect to the rotational axis direction and rotatably supports the secondary transfer roller 25. The bearing 301 for the secondary transfer roller 25 includes a contact surface 302 contacting the secondary transfer separation cam 223. The bearing 301 for the secondary transfer roller 25 is urged in a direction approaching the intermediary transfer belt 13 by a secondary transfer urging spring 304 which is an urging member as an urging means.

In this embodiment, the fixing motor 221 is used not only as a driving source for rotating the fixing roller 51 and the fixing film 52 but also as a driving source for rotating the fixing separation cam 222 and the secondary transfer separation cam 223. When the fixing motor 221 is rotated in a first direction (hereinafter, this rotation is referred to as a "normal rotation"), the fixing roller 51 and the fixing film 52 are rotated, so that the transfer material P can be fed in the fixing portion N3. On the other hand, when the fixing motor 221 is rotated in a second direction opposite to the first direction (hereinafter, this rotation is referred to as a "reverse rotation"), the fixing separation cam 222 is rotated, so that the fixing roller 51 can be moved to a plurality of positions relative to the fixing film 52. In this embodiment, the fixing separation cam 222 moves the fixing roller 51 to a contact position where the fixing roller 51 is contacted to the fixing film 52 and a separated position where the fixing roller 51 is separated from the fixing film 52. Further, the fixing separation cam 222 and the secondary transfer separation cam 223 are drive-connected to each other via a gear train 303 and are rotated in interrelation with each other by the fixing motor 221. Accordingly, when the fixing motor 221 is reversely rotated, the secondary transfer separation cam 223 is rotated, so that the secondary transfer roller 25 can be moved to a plurality of positions relative to the intermediary transfer belt 13. In this embodiment, the secondary transfer separation cam 223 moves the secondary transfer roller 25 to a contact position where the secondary transfer roller 25 is contacted to the intermediary transfer belt 13 and a separated position where the secondary transfer roller 25 is separated from the intermediary transfer belt 13. Incidentally, as described later, in this embodiment, the secondary transfer separation cam 223 is capable of moving the secondary transfer roller 23 to, as the contact position, two positions different in contact pressure of the secondary transfer roller 25 to the intermediary transfer belt 13 (or the opposite roller 15). Here, of these (two) positions, a position (first contact position) where the contact pressure is relatively large is simply referred to a "contact position", and a position (second contact position) where the contact pressure is relatively small is referred to as a "reduced pressure position". In this embodiment, a (speed) reduction ratio from the fixing separation cam 222 to the secondary transfer separation cam 223 is 2:1, and when the fixing separation cam 222 is rotated about 180 degrees, the secondary transfer separation cam 223 is rotated about 90 degrees. Further, in this embodiment, a phase of the fixing separation cam 222 is detected by the phase detecting sensor 224, so that the position of the fixing roller 51 (whether the fixing roller 51 is in the contact position or in the separated position) is detected.

Incidentally, in the embodiment 1 (this embodiment), each of the fixing separation cam 222 and the secondary transfer separation cam 223 is constituted so as to be rotated only in one direction by the reverse rotation of the fixing motor 221.

From a state in which the secondary transfer roller 25 is in the contact position (part (a) of FIG. 3) where the secondary transfer roller 25 is contacted to the intermediary transfer belt 13, the fixing motor 221 is reversely rotated, so that the secondary transfer separation cam 223 is rotated about 90 degrees. By this, the bearing 301 for the secondary transfer roller 25 is pushed by the secondary transfer separation cam 223 and is retracted in a direction separated (spaced) from the intermediary transfer belt 13, so that the secondary transfer roller 25 is moved to the separated position (part (b) of FIG. 3) where the secondary transfer roller 25 is separated from the intermediary transfer belt 13. Next, from a state in which the secondary transfer roller 25 is in the separated position (part (b) of FIG. 3) where the secondary transfer roller 25 is separated from the intermediary transfer belt 13, the fixing motor 221 is reversely rotated, so that the secondary transfer separation cam 223 is rotated about 90 degrees. By this, the bearing 301 for the secondary transfer roller 25 is moved in a direction of approaching the intermediary transfer belt 13 and thus is moved to a reduced pressure position (part (c) of FIG. 3) where the secondary transfer roller 25 is contacted to the intermediary transfer belt 13 in a reduced pressure state. The reduced pressure position is a contact position (second contact position) where a distance between the core metal of the secondary transfer roller 25 and the intermediary transfer belt is larger than the distance in the contact position (first contact position) shown in part (a) of FIG. 3. Next, from a state in which the secondary transfer roller 25 is in the reduced pressure position (part (c) of FIG. 3) where the secondary transfer roller 25 is contacted to the intermediary transfer belt 13, the fixing motor 221 is reversely rotated, so that the secondary transfer separation cam 223 is rotated about 90 degrees. By this, the bearing 301 for the secondary transfer roller 25 is moved in the direction of approaching the intermediary transfer belt 13 and thus is moved to a contact position (part (d) of FIG. 3) where the secondary transfer roller 25 is contacted to the intermediary transfer belt 13. The position of the secondary transfer roller 25 relative to the intermediary transfer belt 13 shown in part (d) of FIG. 3 is substantially the same as the position of the secondary transfer roller 25 relative to the intermediary transfer belt 13 shown in part (a) of FIG. 3. Next, from the state shown in part (d) of FIG. 3, the fixing motor 221 is reversely rotated, so that the secondary transfer separation cam 223 is rotated about 90 degrees. By this operation, the bearing 301 for the secondary transfer roller 25 is not substantially moved, so that shown in part (a) of FIG. 3, the secondary transfer roller 25 is maintained in the contact position (part (a) of FIG. 3) where the secondary transfer roller 25 is contacted to the intermediary transfer belt 13.

FIG. 4 shows a relationship between the position (contact and separation state relative to the fixing film 52) of the fixing roller 51 and the position (contact and separation state relative to the intermediary transfer belt 13) of the secondary transfer roller 25. In the following, states in which the fixing roller 51 and the secondary transfer roller 25 are in positions A, B, C and D shown in FIG. 4 are referred to as "state A", "state B", "state C", and "state D", respectively.

The state A is a state in which the fixing roller 51 is in the contact position and the secondary transfer roller 25 is in the contact position (part (a) of FIG. 3). From the state A, when the fixing separation cam 222 is rotated about 180 degrees and the secondary transfer separation cam 223 is rotated about 90 degrees, the state becomes the state B. The state B is a state in which the fixing roller 51 is in the separated position and the secondary transfer roller 25 is in the separated position (part (b) of FIG. 3). From the state B, when the fixing separation cam 222 is rotated about 180 degrees and the secondary transfer separation cam 223 is rotated about 90 degrees, the state becomes the state C. The state C is a state in which the fixing roller 51 is in the contact position and the secondary transfer roller 25 is in the reduced pressure position (part (c) of FIG. 3). From the state C, when the fixing separation cam 222 is rotated about 180 degrees and the secondary transfer separation cam 223 is rotated about 90 degrees, the state becomes the state D. The state D is a state in which the fixing roller 51 is in the separated position and the secondary transfer roller 25 is in the contact position (part (d) of FIG. 3). Then, from the state D, when the fixing separation cam 222 is rotated about 180 degrees and the secondary transfer separation cam 223 is rotated about 90 degrees, the state returns to the state A.

Incidentally, FIG. 18 is a schematic view of the fixing contact and separation mechanism 400 as a fixing moving mechanism for moving the fixing roller 51 to the plurality of positions relative to the fixing film 52 in the embodiment 1. In the embodiment 1, the fixing contact and separation mechanism 400 is constituted by the fixing separation cam 222, the fixing motor 221, and a bearing 401 for the fixing roller 51, and the like. The fixing separation cam 222 is rotatably provided so as to opposite each of opposite end portions of the fixing roller 51 with respect to the rotational axis direction. The fixing separation cam 222 is rotatable about a rotational axis substantially parallel to the rotational axis of the fixing roller 51. The bearing 401 of the fixing roller 51 is provided at each of opposite end portions of the fixing roller 51 with respect to a rotational axis direction, and rotatably supports the fixing roller 51. The bearing 401 of the fixing roller 51 includes a contact surface 402 contacting the fixing separation cam 222. The bearing 401 of the fixing roller 51 is urged in a direction of approaching the fixing film 52 by a fixing urging spring 404 which is an urging member as an urging means. When the fixing motor 221 is reversely rotated, drive is transmitted to the fixing separation cam 222 via a gear train 403, so that the fixing separation cam 222 is rotated. As described above, in the embodiment 1, every time when the fixing separation cam 222 is rotated about 180 degrees, the fixing roller 51 can be moved to the contact position and the separated position relative to the fixing film 52. Further, in this embodiment, the phase detecting sensor 224 is capable of detecting that fixing separation cam 222 is in a phase where the fixing roller 51 is disposed at the contact position and that the fixing separation cam 222 is in a phase where the fixing roller 51 is disposed at the separated position. In this embodiment, the phase detecting sensor 224 is constituted by including an optical sensor for detecting a flag 225 provided on the fixing separation cam 222. In the following, a signal inputted to (by the movement controller 203) the controller 200 (movement controller 203) by the phase detecting sensor 224 when the fixing separation cam 222 is in a phase (phase range) where the fixing roller 51 is disposed at the contact position is referred to as a "contact detection signal". Further, a signal inputted to (acquired by the movement controller 203) the controller 200 (movement controller 203) by the phase detecting sensor 224 when the fixing separation cam 222 is in a phase (phase range) where the fixing roller 51 is disposed at the separated position is referred to as a "separation detection signal".

5. Movement Control of Secondary Transfer Roller

Next, using part (a) of FIG. 5, movement control of the secondary transfer roller 25 by the controller 200 (movement controller 203) in the embodiment 1 will be described. Part (a) of FIG. 5 is a timing chart showing states of respective portions in the cases where the positions of the fixing roller 51 and the secondary transfer roller 25 are moved from the state A to the state B, from the state B to the state C, from the state C to the state D, and from the state D to the state A, which are shown in FIG. 4. In part (a) of FIG. 5, each of t100 to t111 represents a timing.

The movement controller 203 causes the fixing motor 221 to be reversely rotated, so that the movement from the state A to the state B is started (t100). When the movement controller 203 detects that the signal from the phase detecting sensor 224 is switched from the contact detection signal to the separation detection signal (t101), the movement controller 203 awaits until a time Tf has elapsed. Then, the movement controller 203 stops the drive of the fixing motor 221 when the time Tf has elapsed, so that the movement to the state B is completed (t102). The movements from the state B to the state C, from the state C to the state D, and from the state D to the state A are similarly performed. That is, the movement controller 203 causes the fixing motor 221 to be reversely rotated, so that the associated movement between the respective states is started (t103, t106, t109). Further, the movement controller 203 awaits until the time Tf has elapsed when detects that the signal from the phase detecting sensor 223 is switched (t104, t107, t110). Then, the movement controller 203 causes the fixing motor 221 to stop the drive thereof when the time Tf has elapsed, so that the movement between the respective states is completed (t105, t108, t111).

In the embodiment 1, the time Tf from the detection that the signal from the phase detecting sensor 224 is switched until the drive of the fixing motor 221 is stopped (the movement of the secondary transfer roller 25 is completed) is 100 msec. However, the present invention is not limited to this, and the time Tf can be appropriately set depending on a structure or the like of the phase detecting sensor 224. Incidentally, as regards the time Tf, a different time may be set for a part or all of movements of the secondary transfer roller 25 to the separated position, the reduced pressure position, and the contact position.

Further, in the embodiment 1, a constitution in which the drive of the fixing motor 211 is stopped (the movement of the secondary transfer roller 25 is completed) after a lapse of a predetermined time from detection that the signal from the phase detecting sensor 224 is switched is employed, but the present invention is not limited thereto. For example, a constitution in which the drive of the fixing motor 211 is stopped (the movement of the secondary transfer roller 25 is completed) after a rotation distance of the fixing motor 221 reaches a predetermined distance from the detection that the signal from the phase detecting sensor 224 is switched may be employed.

6. Relationship between a Position of Secondary Transfer Roller and Current Value Next, using part (b) of FIG. 5, a relationship between the position of the secondary transfer roller 25 and a current value acquired from the current detection circuit 27 by the controller 200 (current detection controller 205) in the embodiment 1 will be described. Part (b) of FIG. 5 is a timing chart showing a voltage applied to the secondary transfer roller 25 by the secondary transfer power source 26 and a detection result of a current value acquired from the current detection circuit 27 by the current detection controller 205, during an operation shown in part (a) of FIG. 5. In this embodiment, the voltage applied from the secondary transfer power source 26 to the secondary transfer roller 25 in order to detect the position of the secondary transfer roller 25 is a DC voltage of the positive polarity.

In the states A, B, C and D, when the voltage is applied to the secondary transfer roller 25, current values as shown in part (b) of FIG. 5 are detected. A current value I1 is a current value in the case where the secondary transfer roller 25 is in the contact position (state A, state D) or the reduced pressure position (state C). Further, a current value 12 is a current value in the case where the secondary transfer roller 25 is in the separated position (state B).

Here, although the reduced pressure position (state C) is a reduced pressure state compared with the contact position (state A, state D), the reduced pressure position (state C) is a state in which the secondary transfer roller 25 is contacted to the intermediary transfer belt 13 (or the opposite roller 15). For that reason, in this embodiment, the detection result of the current value acquired by the current detection controller 205 when the voltage is applied to the secondary transfer roller 25 is equivalent between the contact position (state A, state D) and the reduced pressure position (state C).

7. Detection of Position of Secondary Transfer Roller

Next, detection (discrimination) of the position of the secondary transfer roller 25 by the controller (position detection controller 206) in the embodiment 1 will be described.

Here, in this embodiment, the detection (discrimination) of the position of the secondary transfer roller 25 refers to association between the phase of the fixing separation cam 222 and the position of the secondary transfer roller 25 (whether the secondary transfer roller 25 is in the contact position or the separated position) at a predetermined point of time (for example, at present). Specifically, the detection (discrimination) of the secondary transfer roller position refers to that information for establishing the association is stored in a predetermined storage area in a storing means (the memory 212 such as the RAM). That is, a manner of enabling placement of the secondary transfer roller 25 at which position when the fixing separation cam 222 (fixing motor 221) is rotated from the state at the above-described predetermined time to what degree (time or distance) is enabled to be specified. Particularly, in this embodiment, on the basis of the detection result of the phase detecting sensor 224, it is possible to detect that the fixing roller 51 is in the contact position (state A or state C). Further, in this embodiment, in the case where the fixing roller 51 is in the contact position (state A or state C), it has been understood that the secondary transfer roller 25 is in the contact position or the reduced pressure position. Accordingly, on the basis of the detection result of the phase detecting sensor 224, it is possible to detect that when the fixing roller 51 is in the contact position, the secondary transfer roller 25 is in the contact position or the reduced pressure position (the state in which the secondary transfer roller 25 is contacted to the intermediary transfer belt 13). On the other hand, in this embodiment, in the case where the fixing roller 51 is in the separated position (state B or state D), from the detection result of the phase detecting sensor 224, whether the secondary transfer roller 25 is in the contact position or the separated position cannot be understood. For that reason, in this embodiment, on the basis of the current value of the current flowing through the secondary transfer roller 25, the position detection controller 206 detects the position of the secondary transfer roller 25 (whether the secondary transfer roller 25 is in the contact position or the separated position) in the case where the fixing roller 51 is in the separated position (state B or state D). Incidentally, as described above, in this embodiment, when the fixing motor 221 is reversely rotated, the positions of the fixing roller 51 and the secondary transfer roller 25 are successively changed in the order to the states A, B, C and D. For that reason, when the position of the secondary transfer roller 25 at at least one predetermined point of time when the secondary transfer roller 25 is in the separated position is detected, the position of the secondary transfer roller 25 at any point of time before and after the predetermined point of time can be detected on the basis of the detection result of the phase detecting sensor 224.

Specifically, in the embodiment 1, the position detection controller 206 executes a position detecting operation (position discriminating operation) for detecting (discriminating) the position of the secondary transfer roller 25 as described below. That is, in at least one of the state A and the state B, the position detection controller 206 acquires a voltage value necessary to cause a current with a predetermined current value to flow through the secondary transfer roller 25. The states A and C are a state in which detection that the fixing roller 51 is in the contact position is made by the phase detecting sensor 224. Further, in at least one of the states B and D, the position of the secondary transfer roller 25 is detected on the basis of the current value of the current flowing through the secondary transfer roller 25 when the voltage with the above-acquired voltage value is applied to the secondary transfer roller 25. The states B and D are a state in which detection in that the fixing roller 51 is in the separated position is made by the phase detecting sensor 24. Particularly, in the embodiment 1, current values are acquired in one state and the other state of the states B and D and then are compared with each other, so that the positions of the secondary transfer roller 25 corresponding to these states, respectively, are detected.

FIG. 6 is a timing chart of an example of the position detecting operation in the embodiment 1. In FIG. 6, an example of the case where the voltage value of the voltage applied to the secondary transfer roller 25 is determined when the position of the secondary transfer roller 25 is detected in the state C and then the position of the secondary transfer roller 25 is detected in each of the states D and B is shown. Incidentally, for convenience, description will be made on assumption that the voltage value is determined in the state C and then the position of the secondary transfer roller 25 is detected in the states D and B, but it is unknown that whether the state in which the voltage value was determined is the state C or the state A until the position of the secondary transfer roller 25 is detected. In FIG. 6, each of t200 to t213 represents a timing.

The position detection controller 206 causes the voltage controller 204 to start application of a voltage (first test voltage) from the secondary transfer power source 26 to the secondary transfer roller 25 in the state in which the fixing roller 51 is in the contact position (t200). Then, the position detection controller 206 awaits until a time Tv1 to stabilize an output of the voltage has elapsed (t201). Then, after a lapse of the time Tv1, the position detection controller 206 causes the voltage controller 204 to control the secondary transfer power source 26 in order that the current value acquired from the current detection circuit 27 converges to a predetermined transfer current value It. That is, an output value of the voltage is decreased in the case where the acquired current value is larger than the target current value It, and is increased in the case where the acquired current value is smaller than the target current value It (t201 to t202). When the acquired current value converges to the target current value It (t202), the position detection controller 206 calculates, R times (total time Tr) at a certain interval Ts, an average of a voltage value (average voltage value) Vave set for the secondary transfer power source 26 by the voltage power source 204 (t203).

The position detection controller 206 causes a predetermined storage area (the memory 212 such as the RAM) to store this average voltage value Vave. Further, substantially at the same time, the position detection controller 206 causes the voltage controller 204 to stop application of the voltage (first test voltage) from the secondary transfer power source 26 to the secondary transfer roller 25 (t203). By the above-described manner, the position detection controller 206 determines, as the voltage value of the voltage applied to the secondary transfer roller 25 when the position of the position of the secondary transfer roller 25 is detected, the voltage value Vave necessary to cause the current with the predetermined current value It to flow through the secondary transfer roller 25.

Here, the position detection controller 206 determines the voltage value Vave such that irrespective of an electric resistance value of the secondary transfer roller 25, a difference between the current value detected in a state in which the secondary transfer roller 25 is in the separated position and the current value detected in a state in which the secondary transfer roller 25 is in the contact position becomes a certain value or more. Further, the position detection controller 206 determines the voltage value Vave such that the current flowing through the secondary transfer roller 25 does not become excessive. That is, the target current value It is set in such a manner. This voltage value Vave may be equal to the value of the secondary transfer voltage applied to the secondary transfer roller 25 during the secondary transfer or may be a voltage value larger or smaller in absolute value than the value of the secondary transfer voltage. In the embodiment 1, this voltage value Vave is set so that the absolute value thereof is smaller than the absolute value of the secondary transfer voltage applied to the secondary transfer roller 25 during the secondary transfer.

Then, the position detection controller 206 causes the movement controller 203 to move the fixing roller 51 to the separated position so that the current value of the current flowing through the secondary transfer roller 25 in a first position of the secondary transfer roller 25 when the fixing roller 51 is in the separated position. That is, the position detection controller 206 causes the fixing motor 221 to start the reverse rotation (t204), and when detection that the signal from the phase detecting sensor 224 is switched from the contact detection signal to the separation detection signal is made (t205), the position detection controller 206 awaits until the time Tf has elapsed. Then, the position detection controller 206 causes the fixing motor 221 to stop the drive thereof when the time Tf has elapsed, so that the movement of the fixing roller 51 is completed (t206). Further, substantially at the same time, the position detection controller 206 causes the voltage controller 204 to start application of the voltage (second test voltage) from the secondary transfer power source 26 to the secondary transfer roller 25 (t206). This voltage value is the voltage value (average voltage value) Vave determined at t203. After a lapse of the time Tv1 until the output of the voltage is stabilized (t207), the position detection controller 206 causes the current detection controller 205 to acquire, S times (total time Ti) at a certain interval Ts, the current value detected by the current detection circuit 27. Then, the position detection controller 206 calculates an average (average current value) Iave1 of the current flowing through the secondary transfer roller 25 in a first position of the secondary transfer roller 25 when the fixing roller 51 is in the separated position (t208). The position detection controller 206 causes the predetermined storage area (the memory 212 such as the RAM) to store this average current value Iave1. Further, substantially at the same time, the position detection controller 206 causes the voltage controller 204 to stop application of the voltage (second test voltage) from the secondary transfer power source 26 to the secondary transfer roller 25 (t208).

Then, the position detection controller 206 causes the movement controller 203 to move the fixing roller 51 to the separated position in order to detect the current value of the current flowing through the secondary transfer roller 25 in a second position of the secondary transfer roller 25 when the fixing roller 51 is in the separated position. That is, after the application of the voltage (second test voltage) from the secondary transfer power source 26 to the secondary transfer roller 25 is stopped as described above (t208), the position detection controller awaits a lapse of a time Tv2 until the output of the secondary transfer power source 26 is stopped. Then, the position detection controller 206 causes the fixing motor 221 to start the reverse rotation when the time Tv2 has elapsed and then to start movement of the fixing roller 51 to the separated position again via the contact position (t209). Thereafter, when the position detection controller 206 detects that the signal from the phase detecting sensor 224 is switched from the contact detection signal to the separation detection signal (t210), the position detection controller 206 awaits until the time Tf has elapsed. Then, the position detection controller 206 causes the fixing motor 221 to stop the drive thereof when the time Tf has elapsed, so that the movement of the fixing roller 51 is completed (t211). Further, substantially at the same time, the position detection controller 206 causes the voltage controller 204 to start application of the voltage (second test voltage) from the secondary transfer power source 26 to the secondary transfer roller 25 (t211). This voltage value is the voltage value (average voltage value) Vave determined at t203. After a lapse of the time Tv1 until the output of the voltage is stabilized (t212), the position detection controller 206 causes the current detection controller 205 to acquire, S times (total time Ti) at a certain interval Ts, the current value detected by the current detection circuit 27. Then, the position detection controller 206 calculates an average (average current value) Iave2 of the current flowing through the secondary transfer roller 25 in a second position of the secondary transfer roller 25 when the fixing roller 51 is in the separated position (t213). The position detection controller 206 causes the predetermined storage area (the memory 212 such as the RAM) to store this average current value Iave2. Further, substantially at the same time, the position detection controller 206 causes the voltage controller 204 to stop application of the voltage (second test voltage) from the secondary transfer power source 26 to the secondary transfer roller 25 (t213).

The position detection controller 206 compares the average current value Iave1 in the first position of the secondary transfer roller 25 and the average current value Iave2 in the second position of the secondary transfer roller 25 with each other. Then, the position detection controller 206 discriminates that the larger current value corresponds to the state D (in which the secondary transfer roller 25 is in the contact position) and that the smaller current value corresponds to the state B (in which the secondary transfer roller 25 is in the separated position). Further, the position detection controller 206 causes the predetermined storage area (the memory 212 such as the RAM) to store, for example, information for associating a present position (contact position or separated position) of the secondary transfer roller 25 and the phase of the fixing separation cam 222 with each other.

In the embodiment 1, in a state (in which the secondary transfer roller 25 is in the contact position or the reduced pressure position) in which the secondary transfer roller 25 is contacted to the intermediary transfer belt 13, the voltage value Vave necessary for causing the current with a predetermined current value to flow through the secondary transfer roller 25 is acquired. Then, the voltage value Vave is determined as the voltage value of the voltage applied to the secondary transfer roller 25 when the position of the secondary transfer roller 25 is detected. Accordingly, the average current value Iave1 detected in the state in which the secondary transfer roller 25 is in the contact position becomes a value close to the above-described target current value It. On the other hand, the average current value Iave2 detected in the state in which the secondary transfer roller 25 is in the separated position becomes a value smaller than the average current value Iave1 detected in the state in which the secondary transfer roller 25 is in the contact position.

Thus, according to the embodiment 1, irrespective of the electric resistance value of the secondary transfer roller 25, the current value of the current flowing through the secondary transfer roller 25 in the state in which the secondary transfer roller 25 is contacted to the intermediary transfer belt 13 can be caused to be brought close to the predetermined current value It. For that reason, irrespective of the electric resistance value of the secondary transfer roller 25, the position of the secondary transfer roller 25 (whether the secondary transfer roller 25 is in the contact position or the separated position) can be detected (discriminated) accurately. Further, flowing of the excessive current through the secondary transfer roller 25 is suppressed, so that simplification of the constitutions of the current detection circuit 27 and the secondary transfer roller 25 can be realized.

Incidentally, in this embodiment, as an example, the case where the voltage value Vave is determined in the state in which the secondary transfer roller 25 is in the reduced pressure position (state C) was described. The voltage value Vave can be determined similarly even in a state in which the secondary transfer roller 25 is in the contact position (state A).

Further, in this embodiment, the acquired average voltage value Vave was determined as the voltage value of the voltage applied to the secondary transfer roller 25 when the position of the secondary transfer roller 25 is detected, but the present invention is not limited thereto. For example, a voltage value obtained by subjecting the acquired average voltage value to predetermined processing such as multiplication thereof by a predetermined coefficient may be determined as the voltage value of the voltage applied to the secondary transfer roller 25 when the position of the secondary transfer roller 25 is detected.

8. Procedure of Position Detecting Operation

Next, using FIGS. 7 to 10, a procedure of the position detecting operation in the embodiment 1 will be described. FIG. 7 is a flowchart showing the procedure of the position detecting operation in the embodiment 1. Each of FIGS. 8 to 10 is a flowchart showing a procedure of a part of a process executed in the procedure shown in FIG. 7. In the embodiment 1, this position detecting operation is executed in, for example, a preparatory operation such as an operation at the time of turning on a main switch of the image forming apparatus 100 or an operation at the time when the state of the image forming apparatus 100 is restored from a sleep state.

The position detection controller 206 checks whether or not the fixing roller 51 is in the contact position (S101), and in the case where the fixing roller 51 is not in the contact position ("No" of S101), the position detection controller 206 causes the movement controller 203 to execute a contact operation in which the fixing roller 51 is moved to the contact position (S102). Part (a) of FIG. 8 is the flowchart showing the procedure of the contact operation of the fixing roller 51 in S102 of FIG. 7. The movement controller 203 causes the fixing motor 221 to be reversely rotated (S201), and then awaits until switching of the signal of the phase detecting sensor 224 from the separation detection signal to the contact detection signal is detected ("No" of S202). When the movement controller 203 detected that the signal of the phase detecting sensor 224 is switched from the separation detection signal to the contact detection signal ("Yes" of S202), the movement controller 203 awaits until the time Tf has elapsed ("No" of S203). Then, when the time Tf has elapsed ("Yes" of S203), the movement controller 203 causes the fixing motor 221 to stop drive thereof (S204), so that the contact operation of the fixing roller 51 is completed.

Then, the position detection controller 206 causes the voltage controller 204 to apply the voltage (first test voltage) to the secondary transfer roller 25 (S103), and then awaits until the time Tv1 has elapsed ("No" of S104). Then, when the time Tv1 has elapsed ("Yes" of S104), the position detection controller 206 executes rough control (S105) and fine control (S106), so that the current value of the current flowing through the secondary transfer roller 25 is caused to converge to the predetermined target current value It. When the current value of the current flowing through the secondary transfer roller 25 is caused to converge to the target current value It by the rough control (S105) and the fine control (S106), the position detection controller 206 calculates the average of the voltage values (average voltage value) Vave (S107). Further, substantially at the same time, the position detection controller 206 causes the voltage controller 204 to stop the application of the voltage (first test voltage) to the secondary transfer roller 25 (S108).

Part (a) of FIG. 9 is the flowchart showing the procedure of the rough control in S105 of FIG. 7. The position detection controller 206 causes the current detection controller 205 to acquire the current value of the current flowing through the secondary transfer roller 25 (S401). In the case where an absolute value of a difference between the target current value It and a detected current value is larger than a threshold Ith1 ("No" of S402) and the detected current value is larger than the target current value It ("Yes" of S403), the position detection controller 206 decreases the absolute value of the voltage by Vd1 (S404). Further, in the case where the detected current value is not more than the target current value It ("No" of S403), the position detection controller 206 increase the absolute value of the voltage by Vd1 (S405). Thereafter, the position detection controller 206 awaits until the time Ts has elapsed ("No" of S406). Then, when the time has elapsed ("Yes" of S406), the position detection controller 206 acquires the current value again (S401). Thus, when the absolute value of the difference between the target current value It and the detected current value is not more than the threshold Ith1 ("Yes" of S402), the position detection controller 206 ends the rough control. Part (b) of FIG. 9 is the flowchart showing the procedure of the fine control in S106 of FIG. 7. The position detection controller 206 causes the current detection controller 205 to acquire the current value of the current flowing through the secondary transfer roller 25 (S501). In the case where an absolute value of a difference between the target current value It and a detected current value is larger than a threshold Ith2 Ith1) ("No" of S502) and the detected current value is larger than the target current value It ("Yes" of S503), the position detection controller 206 decreases the absolute value of the voltage by Vd2 (<Vd1) (S504). Further, in the case where the detected current value is not more than the target current value It ("No" of S503), the position detection controller 206 increase the absolute value of the voltage by Vd2 (S505). Thereafter, the position detection controller 206 awaits until the time Ts has elapsed ("No" of S506). Then, when the time has elapsed ("Yes" of S506), the position detection controller 206 acquires the current value again (S501). Thus, when the absolute value of the difference between the target current value It and the detected current value is not more than the threshold Ith2 ("Yes" of S502), the position detection controller 206 ends the fine control. FIG. 10 is the flowchart showing the procedure of a process of calculating the average voltage value Vave in S107 of FIG. 7. The position detection controller 206 causes the current detection controller 205 to acquire the current value of the current flowing through the secondary transfer roller 25 (S601). In the case where the number of times of acquisition of the current value is less than R ("No" of S602) and the detected current value is larger than the target current value It ("Yes" of S603), the position detection controller 206 decreases the absolute value of the voltage by Vd2 (S604). Further, in the case where the detected current value is smaller than the target current value It ("No" of S603 and "Yes" of S605), the position detection controller 206 increase the absolute value of the voltage by Vd2 (S606). Incidentally, the position detection controller 206 does not change the voltage in the case where the detected current value is equal to the target current value It ("No" of S605). Thereafter, the position detection controller 206 awaits until the time Ts has elapsed ("No" of S607). When the time Ts has elapsed ("Yes" of S607), the position detection controller 206 acquires the current value again (S601). Then, when the number of times of acquisition of the current value becomes R or more ("Yes" of S602), the position detection controller 206 calculates the average voltage value Vave (S608). The position detection controller 206 causes the storage area (the memory 212 such as the RAM) to store this average voltage value Vave. That is, the position detection controller 206 determines, as the voltage value of the voltage applied to the secondary transfer roller 25 when the position of the secondary transfer roller 25 is detected, the voltage value Vave necessary to cause the current with the predetermined current value It to flow through the secondary transfer roller 25.

As described above, when the application of the voltage (first test voltage) to the secondary transfer roller 25 is stopped (S108), the position detection controller 206 causes the movement controller 203 to execute a separation operation in which the fixing roller 51 is moved to the separation position (S109). Part (b) of FIG. 8 is the flowchart showing the procedure of the separation operation of the fixing roller 51 in S109 of FIG. 7. The movement controller 203 causes the fixing motor 221 to be reversely rotated (S301), and then awaits until switching of the signal of the phase detecting sensor 224 from the contact detection signal to the separation detection signal is detected ("No" of S302). When the movement controller 203 detected that the signal of the phase detecting sensor 224 is switched from the contact detection signal to the separation detection signal ("Yes" of S302), the movement controller 203 awaits until the time Tf has elapsed ("No" of S303). Then, when the time Tf has elapsed ("Yes" of S303), the movement controller 203 causes the fixing motor 221 to stop drive thereof (S304), so that the separation operation of the fixing roller 51 is completed.

Then, the position detection controller 206 causes the voltage controller 204 to apply the voltage (second test voltage) with the above-described voltage value Vave to the secondary transfer roller 25 (S110), and then awaits until the time Tv1 has elapsed ("No" of S111). Then, when the time Tv1 has elapsed ("Yes" of S111), the position detection controller 206 causes the current detection controller 205 to acquire, S times in an interval of the time Ts, the current value of the current flowing through the secondary transfer roller 25 (S112 to S114). When the current value is acquired S times ("Yes" of S113), the position detection controller 206 calculates the average of the acquired current values (average current value) Iave1 (S115). The position detection controller 206 causes the storage area (the memory 212 such as the RAM) to store this average current value Iave1. Further, the position detection controller 206 causes the voltage controller 204 to stop the application of the voltage (first test voltage) to the secondary transfer roller 25 (S116).

Then, the position detection controller 206 checks whether or not the average current value is calculated two times (S117). In the case where the average current value is not calculated two times ("No" of S117), similarly as the case of the above-described first calculation (acquiring process) of the average current value Iave1, the position detection controller 206 performs second calculation of the average current value Iave2 after the secondary transfer roller 25 is moved (S109 to S116).

When the position detection controller 206 performs the second calculation of the average current value Iave2 ("Yes" of S117), the position detection controller 206 compares an absolute value of a difference between the average current value Iave1 in the first calculation and the average current value Iave2 in the second calculation with an error threshold Ierr (S118). Then, in the case where the error threshold Ierr is larger than the absolute value of the difference ("Yes" of S118), the position detection controller 206 discriminates that detection of the position of the secondary transfer roller 25 failed (S119). In the case where the absolute value of the difference is not less than the error threshold Ierr ("No" of S118), the position detection controller 206 compares the average current value Iave1 in the first calculation and the average current value Iave2 in the second calculation with each other (S120). Then, in the case the average current value Iave2 is larger than the average current value Iave1 ("Yes" of S120), the position detection controller 206 discriminates that the present position of the secondary transfer roller 25 is the contact position (S121). Further, in the case where the average current value Iave1 is larger than the average current value Iave2 ("No" of S120), the position detection controller 206 discriminates that the present position of the secondary transfer roller 25 is the separated position (S122). In S121 and S122, the position detection controller 206 causes the storage area (the memory 212 such as the RAM) to store information for associating the present position of the secondary transfer roller 25 and the phase of the fixing separation cam 222 with each other.

Here, in S119, the position detection controller 206 is capable of causing a display portion provided at an operating portion (not shown) of the image forming apparatus 100 or a display portion of an external device (not shown) such as a personal computer connected to the image forming apparatus 100 to make error display. In place of or in addition to the display in the display portion, generation of voice by a voice generating portion or light emission by a light emitting portion may be performed. Or, at this time, for example, the position detecting operation may also be executed again until the number of times of the execution of the position detecting operation reaches a predetermined number.

Incidentally, in this embodiment, the detected current value is caused to converge to the target current value by two-stage control consisting of the rough control and the fine control. However, the present invention is not limited to this, and for example, the detected current value may also be caused to converge to the target current value by one-stage control corresponding to the above-described fine control.

9. Effect

As described above, the image forming apparatus 100 of the embodiment 1 includes the image bearing member (intermediary transfer belt) 13 for bearing the toner image, the transfer member (secondary transfer roller) 25 for forming the transfer portion (secondary transfer portion) N2 where the toner image is transferred from the image bearing member 13 onto the transfer material P in contact with the image bearing member 13, the moving portion (secondary transfer separation cam) 223 for moving the transfer member P, relative to the image bearing member 13, to the plurality of positions including the contact position where the transfer member 25 is contacted to the image bearing member 13 and the separated position where the transfer member 25 is separated from the image bearing member 13, the driving portion (fixing motor) 221 for driving the moving portion 223, the applying portion (secondary transfer power source) 26 for applying the voltage to the transfer member 25, the first detecting portion (voltage controller 204, current detection circuit 28) for detecting at least one of the voltage applied to the transfer member 25 by the applying portion 26 and a current flowing through the transfer member 25 when the voltage is applied to the transfer member 25 by the applying portion 26, and the second (position) detecting portion (position detection controller) 206 for detecting the position of said transfer member 25. On the basis of a detection result of the first detecting portion 204 when the first test voltage is applied to the transfer member 25 by the applying portion 26, the second detecting portion 206 sets the second test voltage. The second detecting portion 206 detects the position of the transfer member 25 on the basis of a detection result of the current value by the first detecting portion 204 acquired when the second test voltage is applied to the transfer member 25 by the applying portion 26.

In the embodiment 1, the position detecting portion (second detecting portion) 206 executes the a position detecting operation for detecting the position of the transfer member 25 by moving the transfer member 25 to the positions relative to the image bearing member 13 by the moving portion 223, and the position (second) detecting portion 206 sets the second test voltage applied to the transfer member 25 in the position detecting operation, on the basis of the detection result of the first detecting portion 204 acquired by applying the first test voltage to the transfer member 25. Further, in the embodiment 1, the position detecting portion 206 sets the second test voltage on the basis of the detection result of the voltage value by the first detecting portion 204 acquired when the voltage value of the first test voltage is adjusted so that the current value of the current flowing through the transfer member 25 approaches the predetermined current value. Particularly, in the embodiment 1, the position detecting portion 206 moves the transfer member 25 to the first position and the second position which are one position and the other position of the positions consisting of the contact position and the separated position in the position detecting operation, and the position detecting portion acquires the detection result of the current value by the detecting portion 27 under application of the second test voltage to the transfer member 25 by the applying portion 26 when the transfer member is in each of the first position and the second position. Then, the position detecting portion 206 outputs at least one of information indicating that the first position is the contact position and information indicating that the second position is the separated position in the case where the current value acquired when the transfer member 25 is in the first position is larger than the current value acquired when the transfer member 25 is in the second position. Further, the position detecting portion 206 outputs at least one of information indicating that the first position is the separated position and information indicating that the second position is the contact position in the case where the current value acquired when the transfer member 25 is in the first position is smaller than the current value acquired when the transfer member 25 is in the second position. For example, the position detecting portion 206 outputs the information to the memory 212 and can cause the memory 212 to store the information. Further, in the embodiment 1, in the case where a difference between the current value acquired when the transfer member 25 is in the first position and the current value acquired when the transfer member 25 is in the second position is smaller than a predetermined value, the position detecting portion 206 outputs information indicating failure in detection of the position of the transfer member 25. For example, the position detecting portion 226 outputs the information to the display portion on the operating portion provided on the image forming apparatus 100 or the display portion of the external device connected to the image forming apparatus 100 and then can cause the display portion to display the information.

Further, in the embodiment 1, the position second detecting portion 206 sets the second test voltage on the basis of a detection result of the first detecting portion 204 acquired in a state in which the transfer member 25 is in the contact position. Particularly, in the embodiment 1, the image forming apparatus 100 includes the driven portion (fixing separation cam) 222 driven by the driving portion 221 common to the driven portion 222 and the moving portion and movable between the first predetermined position and the second predetermined position and includes the sensor (phase detecting sensor) 224 for detecting the position of the driven portion 222. Further, in the embodiment 1, in the state in which the sensor 224 detected that the driven portion 222 is in the first predetermined position, the transfer member 25 is in the contact position. Further, in the state in which the sensor 224 detected that the driven portion is in the second predetermined position, the transfer member is in the contact position or the separated position. Further, in the embodiment 1, the position detecting portion 206 sets the second test voltage on the basis of a detection result of the first detecting portion 204 acquired in the state in which the sensor 224 detects that the driven portion 222 is in the first predetermined position, and the position detecting portion 206 detects the position of the transfer member 25 on the basis of a detection result of a current value by the first detecting portion 204 acquired in the state in which the sensor 224 detects that the driven portion 222 is in the second predetermined position. In the embodiment 1, the driven portion 222 is a member configured to move the fixing member (fixing roller) 51 for fixing the toner image on the transfer material P. Further, in the embodiment 1, the moving portion 223 is capable of moving the transfer member 25 to, as the contact position, the first contact position and the second contact position, and a contact pressure of the transfer member 25 to the image bearing member 13 is larger when the transfer member 25 is in the first contact position than when the transfer member 25 is in the second position.

Further, according to the embodiment 1, even in the case where the electric resistance value of the secondary transfer roller 25 changes (even in the case where there is a variation), the position of the secondary transfer roller 25 can be detected (discriminated) accurately. Further, flowing of the excessive current through the secondary transfer roller 25 is suppressed, so that it becomes possible to realize simplification of constitutions of the current detection circuit 27 and the secondary transfer roller 25.

Further, in the embodiment 1, in order to determine the voltage value when the position of the secondary transfer roller 25 is detected, the state in which the secondary transfer roller 25 is contacted to the intermediary transfer belt 13 can be detected by the phase detecting sensor 224 for detecting the position of the fixing roller 51. Thus, according to the embodiment 1, a dedicate sensor or the like for detecting (discriminating) the position of the secondary transfer roller is not provided, and therefore, it is possible to realize simplification and downsizing of the apparatus (device) constitution.

Next, another embodiment of the present invention will be described. Basic constitution and operation of an image forming apparatus of an embodiment 2 are the same as those of the image forming apparatus of the embodiment 1. Accordingly, in the image forming apparatus of the embodiment 2, as regards elements having the same or corresponding functions and constitutions as those in the image forming apparatus of the embodiment 1, reference numerals or symbols which are the same as those in the embodiment 1 are added and detailed description thereof will be omitted.

1. Summary of Embodiment 2

In the embodiment 1, in the position detecting operation, the voltage value necessary to cause the current with the predetermined current value to flow through the secondary transfer roller 25 was acquired and was determined as the voltage value applied to the secondary transfer roller 25 when the position of the secondary transfer roller 25 was detected. On the other hand, in the embodiment 2, in the position detecting operation, an electric resistance value of the secondary transfer roller 25 is acquired on the basis of a current value of a current flowing through the secondary transfer roller 25 when a voltage with a predetermined voltage value is applied to the secondary transfer roller 25. Then, on the basis of the electric resistance value, a voltage value applied to the secondary transfer roller 25 when the position of the secondary transfer roller 25 is detected is determined. By this, in the embodiment 2, there is no need to execute the pieces of control such as the rough control and the fine control which are for acquiring the voltage value necessary to cause the current with the predetermined current value to flow through the secondary transfer roller 25 and which are described in the embodiment 1. For that reason, according to the embodiment 2, compared with the embodiment 1, a process time of the position detecting operation can be shortened.

2. Detection of Position of Secondary Transfer Roller

Next, detection (discrimination) of the position of the secondary transfer roller 25 by the controller (position detection controller 206) in the embodiment 2 will be described.

In the embodiment 2, the position detection controller 206 executes the following position detecting operation. That is, in at least one of the state A and the state B, the position detection controller 206 applies a voltage with a predetermined voltage value to the secondary transfer roller 25. Then, the position detection controller 206 detects a current value of a current flowing through the secondary transfer roller 25 at that time and acquires the electric resistance value of the secondary transfer roller 25, so that the position detection controller 206 acquires a voltage value of a voltage applied to the secondary transfer roller 25 when the position of the secondary transfer roller 25 is detected.

The states A and C are a state in which detection that the fixing roller 51 is in the contact position is made by the phase detecting sensor 224. Further, in at least one of the states B and D, the position of the secondary transfer roller 25 is detected on the basis of the current value of the current flowing through the secondary transfer roller 25 when the voltage with the above-acquired voltage value is applied to the secondary transfer roller 25. The states B and D are a state in which detection in that the fixing roller 51 is in the separated position is made by the phase detecting sensor 24. Particularly, in the embodiment 2, current values are acquired in one state and the other state of the states B and D and then are compared with each other, so that the positions of the secondary transfer roller 25 corresponding to these states, respectively, are detected. Incidentally, in the embodiment 2, the voltage applied from the secondary transfer power source 26 to the secondary transfer roller 25 in order to acquire the electric resistance value of the secondary transfer roller 25 and the detect the position of the secondary transfer roller 25 is a DC voltage of the positive polarity.

FIG. 11 is a timing chart of an example of the position detecting operation in the embodiment 2. In FIG. 6, an example of the case where the voltage value of the voltage applied to the secondary transfer roller 25 is determined when the position of the secondary transfer roller 25 is detected in the state C and then the position of the secondary transfer roller 25 is detected in each of the states D and B is shown. Incidentally, for convenience, description will be made on assumption that the voltage value is determined in the state C and then the position of the secondary transfer roller 25 is detected in the states D and B, but it is unknown that whether the state in which the voltage value was determined is the state C or the state A until the position of the secondary transfer roller 25 is detected. In FIG. 11, each of t300 to t312 represents a timing.

The position detection controller 206 causes the voltage controller 204 to start application of a voltage (first test voltage) with a predetermined voltage value Vi from the secondary transfer power source 26 to the secondary transfer roller 25 in the state in which the fixing roller 51 is in the contact position (t300). Then, the position detection controller 206 awaits until a time Tv1 to stabilize an output of the voltage has elapsed (t301). After a lapse of the time Tv1, the position detection controller 206 acquires, S times (total time Ti) at a certain interval Ts, the current value detected by the current detection circuit 27. Then, the position detection controller 206 calculates an average of the acquired current value (average current value) Iave0 (t302).

The position detection controller 206 causes a predetermined storage area (the memory 212 such as the RAM) to store this average current value Iave0. Further, substantially at the same time, the position detection controller 206 causes the voltage controller 204 to stop application of the voltage (second test voltage) from the secondary transfer power source 26 to the secondary transfer roller 25 (t302).

Further, the position detection controller 206 acquires the electric resistance value of the secondary transfer roller 25 and determines the voltage value applied to the secondary transfer roller 25 when the position of the secondary transfer roller 25 is detected, in the following manner. Incidentally, this voltage value may only be required to be determined until application of the voltage to the secondary transfer roller 25 is started for detecting the position of the secondary transfer roller 25 as described later.

The position detection controller 206 calculates an electric resistance value Ri of the secondary transfer roller 25 on the basis of the above-described voltage value Vi and the above-calculated average current value Iave0 by the following formula 1.

$$Ri=Vi/Iave0 \quad \text{(formula 1)}$$

Further, the position detection controller 206 acquires a voltage value Vp necessary to cause a current with a predetermined current value Ip to flow through the secondary transfer roller 25 in the state in which the secondary transfer roller 25 is in the contact position, on the basis of the above-calculated electric resistance value Ri by the following formula 2.

$$Vp=Ip\times Ri \quad \text{(formula 2)}$$

By the above-described manner, the position detection controller 206 acquires the electric resistance value Ri of the secondary transfer roller 25, and determines the voltage value Vp necessary to cause the current with the predetermined current value It to flow through the secondary transfer roller 25. The position detection controller 206 causes a predetermined storage area (the memory 212 such as the RAM) to store the determined voltage value Vp.

The current value detected in the state in which the secondary transfer roller 25 is in the contact position is made a value close to the above-described current value Ip by determining, as the above-described voltage value Vp, the voltage value of the voltage applied to the secondary transfer roller 25 when the position of the secondary transfer roller 25 is detected. Here, in the case where the electric resistance value of the secondary transfer roller 25 is low, the average current value Iave0 calculated as described above becomes a large value. On the other hand, in the case where the electric resistance value of the secondary transfer roller 25 is high, the average current value Iave0 calculated as described above becomes a small value. The position detection controller 206 determines the voltage value Vp such that irrespective of an electric resistance value of the secondary transfer roller 25, a difference between the current value detected in a state in which the secondary transfer roller 25 is in the separated position and the current value detected in a state in which the secondary transfer roller 25 is in the contact position becomes a certain value or more. Further, the position detection controller 206 determines the voltage value Vp such that the current flowing through the secondary transfer roller 25 does not become excessive. That is, the above-described current value Ip is set in such a manner. This voltage value Vp may be equal to the value of the secondary transfer voltage applied to the secondary transfer roller 25 during the secondary transfer or may be a voltage value larger or smaller in absolute value than the value of the secondary transfer voltage. In the embodiment 2, this voltage value Vp is set so that the absolute value thereof is smaller than the absolute value of the secondary transfer voltage applied to the secondary transfer roller 25 during the secondary transfer. Further, the above-described voltage value Vi may be equal to the secondary transfer voltage value of the voltage applied to the secondary transfer roller 25 during the secondary transfer and may also be a voltage value larger or smaller in absolute value than the secondary transfer voltage value. In the embodiment 2, this voltage value Vi is set so as to be smaller in absolute value than the secondary transfer 25 during the secondary transfer.

Then, the position detection controller 206 causes the movement controller 203 to move the fixing roller 51 to the separated position so that the current value of the current flowing through the secondary transfer roller 25 in a first position of the secondary transfer roller 25 when the fixing roller 51 is in the separated position. That is, the position detection controller 206 causes the fixing motor 221 to start the reverse rotation (t303), and when detection that the signal from the phase detecting sensor 224 is switched from the contact detection signal to the separation detection signal is made (t304), the position detection controller 206 awaits until the time Tf has elapsed. Then, the position detection controller 206 causes the fixing motor 221 to stop the drive thereof when the time Tf has elapsed, so that the movement of the fixing roller 51 is completed (t305). Further, substantially at the same time, the position detection controller 206 causes the voltage controller 204 to start application of the voltage (second test voltage) with the above-described voltage value Vp from the secondary transfer power source 26 to the secondary transfer roller 25 (t305). After a lapse of the time Tv1 until the output of the voltage is stabilized (t306), the position detection controller 206 causes the current detection controller 205 to acquire, S times (total time Ti) at a certain interval Ts, the current value detected by the current detection circuit 27. Then, the position detection controller 206 calculates an average (average current value) Iave1 of the current flowing through the secondary transfer roller 25 in a first position of the secondary transfer roller 25 when the fixing roller 51 is in the separated position (t307). The position detection controller 206 causes the predetermined storage area (the memory 212 such as the RAM) to store this average current value Iave1. Further, substantially at the same time, the position detection controller 206 causes the voltage controller 204 to stop application of the voltage (second test voltage) from the secondary transfer power source 26 to the secondary transfer roller 25 (t307).

Then, the position detection controller 206 causes the movement controller 203 to move the fixing roller 51 to the separated position in order to detect the current value of the current flowing through the secondary transfer roller 25 in a second position of the secondary transfer roller 25 when the fixing roller 51 is in the separated position. That is, after the application of the voltage (second test voltage) from the secondary transfer power source 26 to the secondary transfer roller 25 is stopped as described above (t307), the position detection controller awaits a lapse of a time Tv2 until the output of the secondary transfer power source 26 is stopped. Then, the position detection controller 206 causes the fixing motor 221 to start the reverse rotation when the time Tv2 has elapsed and then to start movement of the fixing roller 51 to the separated position again via the contact position (t308). Thereafter, when the position detection controller 206 detects that the signal from the phase detecting sensor 224 is switched from the contact detection signal to the separation detection signal (t309), the position detection controller 206 awaits until the time Tf has elapsed. Then, the position detection controller 206 causes the fixing motor 221 to stop the drive thereof when the time Tf has elapsed, so that the movement of the fixing roller 51 is completed (t310). Further, substantially at the same time, the position detection controller 206 causes the voltage controller 204 to start application of the voltage (second test voltage) with the above-described voltage value Vp from the secondary transfer power source 26 to the secondary transfer roller 25 (t310). After a lapse of the time Tv1 until the output of the voltage is stabilized (t311), the position detection controller 206 causes the current detection controller 205 to acquire, S times (total time Ti) at a certain interval Ts, the current value detected by the current detection circuit 27. Then, the position detection controller 206 calculates an average (average current value) Iave2 of the current flowing through the secondary transfer roller 25 in a second position of the secondary transfer roller 25 when the fixing roller 51 is in the separated position (t312). The position detection controller 206 causes the predetermined storage area (the memory 212 such as the RAM) to store this average current value Iave2. Further, substantially at the same time, the position detection controller 206 causes the voltage controller 204 to stop application of the voltage (second test voltage) from the secondary transfer power source 26 to the secondary transfer roller 25 (t312).

The position detection controller 206 compares the average current value Iave1 in the first position of the secondary transfer roller 25 and the average current value Iave2 in the second position of the secondary transfer roller 25 with each other. Then, the position detection controller 206 discriminates that the larger current value corresponds to the state D (in which the secondary transfer roller 25 is in the contact position) and that the smaller current value corresponds to the state B (in which the secondary transfer roller 25 is in the separated position). Further, the position detection controller 206 causes the predetermined storage area (the memory 212 such as the RAM) to store, for example, information for associating a present position (contact position or separated position) of the secondary transfer roller 25 and the phase of the fixing separation cam 222 with each other.

In the embodiment 2, in a state (in which the secondary transfer roller 25 is in the contact position or the reduced pressure position) in which the secondary transfer roller 25 is contacted to the intermediary transfer belt 13, the electric resistance value Ri of the secondary transfer roller 25 is acquired. Then, on the basis of the electric resistance value Ri, the voltage value Vp necessary for causing the current with the predetermined current value Ip to flow through the secondary transfer roller 25 is acquired, and the voltage value Vp is determined as the voltage value of the voltage applied to the secondary transfer roller 25 when the position of the secondary transfer roller 25 is detected. Accordingly, the average current value Iave1 detected in the state in which the secondary transfer roller 25 is in the contact position becomes a value close to the above-described predetermined current value Ip. On the other hand, the average current value Iave2 detected in the state in which the secondary transfer roller 25 is in the separated position becomes a value smaller than the average current value Iave1 detected in the state in which the secondary transfer roller 25 is in the contact position.

Thus, according to the embodiment 2, irrespective of the electric resistance value of the secondary transfer roller 25, the current value of the current flowing through the secondary transfer roller 25 in the state in which the secondary transfer roller 25 is contacted to the intermediary transfer belt 13 can be caused to be brought close to the predetermined current value Ip. For that reason, irrespective of the electric resistance value of the secondary transfer roller 25, the position of the secondary transfer roller 25 (whether the secondary transfer roller 25 is in the contact position or the separated position) can be detected (discriminated) accurately. Further, flowing of the excessive current through the secondary transfer roller 25 is suppressed, so that simplification of the constitutions of the current detection circuit 27 and the secondary transfer roller 25 can be realized.

Incidentally, in this embodiment, as an example, the case where the voltage value Vp is determined in the state in which the secondary transfer roller 25 is in the reduced pressure position (state C) was described. The voltage value Vp can be determined similarly even in a state in which the secondary transfer roller 25 is in the contact position (state A).

Further, in this embodiment, the electric resistance value of the secondary transfer roller 25 was acquired, but the present invention is not limited to that the electric resistance value itself is acquired. A current value or a voltage value which is correlated with the electric resistance value may be used in the above-described process.

3. Procedure of Position Detecting Operation

Next, using FIG. 12, a procedure of the position detecting operation in the embodiment 2 will be described. FIG. 12 is a flowchart showing the procedure of the position detecting operation in the embodiment 2.

The position detection controller 206 checks whether or not the fixing roller 51 is in the contact position (S701), and in the case where the fixing roller 51 is not in the contact position ("No" of S701), the position detection controller 206 causes the movement controller 203 to execute a contact operation in which the fixing roller 51 is moved to the contact position (S702). The procedure of this contact operation is the same as the contact operation shown in part (a) of FIG. 8 described in the embodiment 1.

Then, the position detection controller 206 causes the voltage controller 204 to apply the voltage (first test voltage) with the predetermined voltage value Vi to the secondary transfer roller 25 (S703), and then awaits until the time Tv1 has elapsed ("No" of S704). Then, when the time Tv1 has elapsed ("Yes" of S704), the position detection controller 206 causes the current detection controller 205 to acquire, S times in an interval of the time Ts, the current value of the current flowing through the secondary transfer roller 25 (S705 to S707). When the current value is acquired S times ("Yes" of S706), the position detection controller 206 calculates the average of the acquired current values (average current value) Iave0 (S708). The position detection controller 206 causes the predetermined storage area (the memory 212 such as the RAM) to store this average current value Iave0. Further, the position detection controller 206 calculates the electric resistance value Ri by the above-described formula 1 (S709), and further calculates the voltage value Vp by the above-described formula 2 (S710). The position detection controller 206 causes the storage area (the memory 212 such as the RAM) to store this voltage value. That is, the position detection controller 206 determines the voltage value Vp of the voltage applied to the secondary transfer roller 25 when the position of the secondary transfer roller 25 is detected. Further, substantially at the same time, the position detection controller causes the voltage controller 204 to stop the application of the voltage (first test voltage) to the secondary transfer roller 25 (S711).

Then, the position detection controller 206 causes the movement controller 203 to execute a separation (spacing) operation for moving the secondary transfer roller 25 to the separated position (S712). The procedure of this separation operation is the same as the procedure shown in part (b) of FIG. 8 described in the embodiment 1. Then, the position detection controller 206 causes the voltage controller 204 to apply the voltage (second test voltage) with the above-described voltage value Vp to the secondary transfer roller 25 (S713), and a waits until the time Tv1 has elapsed ("No" of S714). Then, when the time Tv1 has elapsed ("Yes" of S714), the position detection controller 206 causes the current detection controller 205 to acquire, S times at an interval of a time Ts, the current value of the current flowing through the secondary transfer roller 25 (S715 to S717). When the current values corresponding to the S times are acquired ("Yes" of S716), the position detection controller 206 calculates an average of the acquired current values (average current value) Iave1 (S718). The position detection controller 206 causes the storage area (the memory 212 such as the RAM) to store this average current value Iave1. Further, the position detection controller 206 causes the voltage controller 204 to stop the application of the voltage (first test voltage) to the secondary transfer roller 25 (S719).

Then, the position detection controller 206 checks whether or not the average current value is calculated two times (S720). In the case where the average current value is not calculated two times ("No" of S720), similarly as the case of the above-described first calculation (acquiring process) of the average current value Iave1, the position detection controller 206 performs second calculation of the average current value Iave2 after the secondary transfer roller 25 is moved (S712 to S719).

When the position detection controller 206 performs the second calculation of the average current value Iave2 ("Yes" of S720), the position detection controller 206 compares an absolute value of a difference between the average current value Iave1 in the first calculation and the average current value Iave2 in the second calculation with an error threshold Ierr (S721). Then, in the case where the error threshold Ierr is larger than the absolute value of the difference ("Yes" of S721), the position detection controller 206 discriminates that detection of the position of the secondary transfer roller 25 failed (S722). In the case where the absolute value of the difference is not less than the error threshold Ierr ("No" of S721), the position detection controller 206 compares the average current value Iave1 in the first calculation and the average current value Iave2 in the second calculation with each other (S723). Then, in the case the average current value Iave2 is larger than the average current value Iave1 ("Yes" of S723), the position detection controller 206 discriminates that the present position of the secondary transfer roller 25 is the contact position (S724). Further, in the case where the average current value Iave1 is larger than the average current value Iave2 ("No" of S723), the position detection controller 206 discriminates that the present position of the secondary transfer roller 25 is the separated position (S725). In S724 and S725, the position detection controller 206 causes the storage area (the memory 212 such as the RAM) to store information for associating the present position of the secondary transfer roller 25 and the phase of the fixing separation cam 222 with each other.

4. Effect

As described above, in the embodiment 2, the position detection controller 206 sets the second test voltage on the basis of the predetermined voltage value and the detection result of the current value by the detecting portion 27 acquired when the first test voltage with the predetermined voltage value is applied to the transfer member 25. Particularly, in the embodiment 2, the position detection controller 206 acquires the electric resistance value of the transfer member 25 on the basis of the predetermined voltage value and the detection result of the current value acquired under application of the first test voltage to the transfer member 25, and then sets the second test voltage on the basis of the electric resistance value.

Further, according to the embodiment 2, even in the case where the electric resistance value of the secondary transfer roller 25 changes, the position of the secondary transfer roller 25 can be detected (discriminated) accurately. Further, flowing of the excessive current through the secondary transfer roller 25 is suppressed, so that it becomes possible to realize simplification of constitutions of the current detection circuit 27 and the secondary transfer roller 25.

Further, according to the embodiment 2, the process time of the position detecting operation can be made shorter than in the embodiment 1.

Next, another embodiment of the present invention will be described. Basic constitution and operation of an image forming apparatus of an embodiment 3 are the same as those of the image forming apparatus of the embodiment 1.

Accordingly, in the image forming apparatus of the embodiment 3, as regards elements having the same or corresponding functions and constitutions as those in the image forming apparatus of the embodiment 1, reference numerals or symbols which are the same as those in the embodiment 1 are added and detailed description thereof will be omitted.

1. Summary of Embodiment 3

In the embodiments 1 and 2, during the position detecting operation, the voltage value applied to the secondary transfer roller 25 when the position of the secondary transfer roller 25 was detected was determined. On the other hand, in the embodiment 3, the voltage value of the voltage applied to the secondary transfer roller 25 when the position of the secondary transfer roller 25 is detected in the position detecting operation is determined on the basis of the electric resistance value of the secondary transfer roller 25 acquired before the position detecting operation is executed. Particularly, in the embodiment 3, the electric resistance value of the secondary transfer roller 25 acquired in the image forming operation (particularly in a pre-processing operation (pre-rotation operation) which is a preparatory operation executed before the secondary transfer of the toner image after the start of the image forming operation). By this, in the embodiment 3, during the position detecting operation, there is no need to execute the control in which the voltage is applied to the secondary transfer roller 25 in order to determine the voltage value. For that reason, according to the embodiment 3, compared with the embodiments 1 and 2, a process time of the position detecting operation can be shortened.

2. Control Mode

FIG. 13 is a block diagram showing a control mode relating to detection of the position of the secondary transfer roller 25 in the image forming apparatus 100 of the embodiment 3. The control mode in the embodiment 3 shown in FIG. 13 is almost similar to the control mode in the embodiments 1 and 2 shown in FIG. 2. However, in the embodiment 3, as the functional block, a resistance value calculating portion 207 is further included. Further, in the embodiment 3, the hardware 220 operable under control of the controller 200 includes an environment sensor 226. The resistance value calculating portion 207 acquires the electric resistance value of the secondary transfer roller 25 by the action of the voltage controller 204 and the current detection controller 205 during the image forming operation. The environment sensor 226 is an example of an environment detecting means for detecting at least one of a temperature and a humidity on at least one of an inside and an outside of the image forming apparatus 100, and in this embodiment, is constituted by a temperature/humidity sensor for detecting the temperature and humidity on the inside of the image forming apparatus 100. In this embodiment, the position detection controller 206 acquires an absolute water content on the basis of a detection result of the temperature and the humidity acquired from the environment sensor 226, and the acquired absolute water content is used for determining the voltage value of the voltage applied to the secondary transfer roller 25 when the position of the secondary transfer roller 25 is detected or for the like purpose.

3. Detection of Electric Resistance Value of Secondary Transfer Roller

The detection of the electric resistance value of the secondary transfer roller 25 by the controller 200 (resistance value calculating portion 207) in the embodiment 3 will be described. FIG. 14 is a timing chart showing states of respective portions during the image forming operation in this embodiment. In FIG. 14, t400 to t407 represent associated timings.

When pre-processing of the image forming operation is started, in a state in which the fixing roller 51 and the secondary transfer roller 25 are in their contact positions, the resistance value calculating portion 207 causes the voltage controller 204 to start application of the voltage (first test voltage) from the secondary transfer power source 26 to the secondary transfer roller 25 (t400). Then, the resistance value calculating portion 207 awaits until the time Tv1 to stabilization of the output of the voltage has elapsed (t401). Then, when the time Tv1 has elapsed, the resistance value calculating portion 207 causes the voltage controller 204 to control the secondary transfer power source 26 in order that the current value acquired from the current detection circuit 27 by the current detection controller 205 is caused to converge to a predetermined target current value Ipre. That is, an output value of the voltage is decreased when the acquired current is higher than the target current value Ipre and is increased when the acquired current is lower than the target current value Ipre (t401 to t402).

When the acquired current value converges to the target current value (t402), the resistance value calculating portion 207 calculates, R times (total time Tr) at a certain interval Ts, an average (average voltage value) Vavepre of the voltage value set for the secondary transfer power source 26 by the voltage controller 204 (t403). The position detection controller 206 causes the predetermined storage area (the memory 212 such as the RAM) to store this average voltage value Vavepre. Further, the resistance value calculating portion 207 acquires the electric resistance value of the secondary transfer roller 25 and determines the secondary transfer voltage value of the voltage applied to the secondary transfer roller 25 during the secondary transfer in the following manner. Incidentally, the electric resistance value and the secondary transfer voltage value may only be required to be determined until the application of the secondary transfer voltage is started as described later.

On the basis of the above-described target current value Ipre and the above-calculated average voltage value Vavepre, the resistance value calculating portion 207 calculates an electric resistance value Rpre of the secondary transfer roller 25 by the following formula 3.

$$Rpre = Vavepre / Ipre \quad \text{(formula 3)}$$

Further, the resistance value calculating portion 207 calculates a predetermined voltage value Vprint necessary to cause the current with a predetermined current value Iprint to flow through the secondary transfer roller 25 in the secondary transfer operation, on the basis of the above-calculated electric resistance value Vpre by the following formula 4.

$$Vprint = \alpha \times Iprint \times Rpre + B \quad \text{(formula 4)}$$

As described above, the resistance value calculating portion 207 acquires the electric resistance value Rpre of the secondary transfer roller 25 and determines the secondary transfer voltage value Vprint of the voltage applied to the secondary transfer roller 25 during the secondary transfer. The resistance value calculating portion 207 causes the storage area (the memory 212 such as the RAM) to store the acquired electric resistance value Rpre of the secondary transfer roller 25 and the determined secondary transfer voltage value Vprint of the voltage applied to the secondary transfer roller 25 during the secondary transfer.

Here, in the secondary transfer operation, the transfer material P is present between the secondary transfer roller 25 and the intermediary transfer belt 13 (or the opposite roller 15). For that reason, the electric resistance value of the secondary transfer portion N2 is higher than the above-calculated electric resistance value Rpre by an electric resistance value corresponding to the transfer material P. In the above-described formula 4, α and β are coefficients by which the electric resistance value increased by the transfer material P is taken into consideration and are coefficients determined uniquely under an environment condition such as a temperature or a humidity or a condition such as a basis weight of the transfer material P.

Then, the controller 200 sets, at the voltage value Vprint, the voltage value of the voltage applied to the secondary transfer roller 25 by the voltage controller 204 before a leading end of the transfer material P reaches the secondary transfer portion N2 by a certain time Tva (t404). Then, the controller 200 awaits until a certain time Try has elapsed from arrival of the leading end of the transfer material P at the secondary transfer portion N2 (t405). Then, when the certain time Trb has elapsed, the controller 200 causes the voltage controller 204 to control the secondary transfer power source 26 in order that the current value acquired from the current detection circuit 27 by the current detection controller 205 is caused to converge to the target current value Iprint. That is, the output value of the voltage is decreased when the acquired current value is higher than the target current value Iprint and is increased when the acquired current value is lower than the target current value Tprint (t405 to t406). Further, the controller 200 causes the voltage controller 204 to sets, at the voltage value Vprint, the voltage value of the voltage applied to the secondary transfer roller 25 before a trailing end of the transfer material P reaches the secondary transfer portion N2 by a certain time Tvc (t406). Then, the controller 200 awaits until a lapse of the certain time Tvc from arrival of the trailing end of the transfer material P at the secondary transfer portion N2, and then causes the voltage controller 204 to stop the application of the voltage to the secondary transfer roller 25 (t407).

Thus, in the embodiment 3, the resistance value calculating portion 207 acquires the electric resistance value Rpre of the secondary transfer roller 25 at a pre-processing stage in the image forming operation. This electric resistance value Rpre is used not only for determining the secondary transfer voltage value Vprint during the secondary transfer operation but also for determining the voltage value of the voltage applied to the secondary transfer roller 25 when the position of the secondary transfer roller 25 is detected during the position detecting operation.

4. Detection of Position of Secondary Transfer Roller

Next, detection (discrimination) of the position of the secondary transfer roller 25 by the controller (position detection controller 206) in the embodiment 3 will be described.

FIG. 15 is a timing chart of an example of the position detecting operation in the embodiment 3. In FIG. 15, an example of the case where by using voltage value determined on the basis of the electric resistance value of the secondary transfer roller 25 acquired during the image forming operation as described above, the position of the secondary transfer roller 25 in each of the states D and B is detected is shown. In FIG. 15, each of t500 to t509 represents a timing.

The position detection controller 206 causes the movement controller 203 to move the fixing roller 51 to the separated position so that the current value of the current flowing through the secondary transfer roller 25 can be detected in a first position of the secondary transfer roller 25 when the fixing roller 51 is in the separated position. That is, the position detection controller 206 causes the fixing motor 221 to start the reverse rotation (t500), and when detection that the signal from the phase detecting sensor 224 is switched from the contact detection signal to the separation detection signal is made (t501), the position detection controller 206 awaits until the time Tf has elapsed. Then, the position detection controller 206 causes the fixing motor 221 to stop the drive thereof when the time Tf has elapsed, so that the movement of the fixing roller 51 is completed (t502). Further, on the basis of the electric resistance value Rpre of the secondary transfer roller 25 acquired during the image forming operation before the detecting operation of the position is executed, the position detection controller 206 determines the voltage value Vp of the voltage applied to the secondary transfer roller 25 when the position of the secondary transfer roller 25 is detected. Incidentally, this voltage value Vp may only be required to be determined until the voltage application to the secondary transfer roller 25 is started for detecting the position of the secondary transfer roller 25 as described later. Calculation may be made during movement of the secondary transfer roller 25.

FIG. 16 is a graph, for illustrating a method of determining the voltage value Vp in the embodiment 3, showing a relationship between the absolute water content detected by the environment sensor 226 and the voltage value of the voltage outputted by the secondary transfer power source 26. The position detection controller 26 causes the predetermined storage area (the memory 212 such as the RAM) to store voltage values Vh1, Vh2 and Vh3 in advance necessary to cause the current with the current value Ip to flow through the secondary transfer roller 25 in absolute water contents E1, E2 and E3, respectively, in the case where the electric resistance value of the secondary transfer roller 25 is an assumed highest electric resistance value Rh. Similarly, the position detection controller 26 causes the predetermined storage area (the memory 212 such as the RAM) to store voltage values V11, V12 and V13 in advance necessary to cause the current with the current with the current value Ip to flow through the secondary transfer roller 25 in the absolute water contents E1, E2 and E3, respectively, in the case where the electric resistance value of the secondary transfer roller 25 is an assumed lowest electric resistance value R1. Here, as shown in FIG. 16, in the case where the absolute water content when the position detecting operation is Ep and the electric resistance value of the secondary transfer roller 25 acquired during the image forming operation is Rp, the position detection controller 206 calculates the voltage value Vp in the following manner. That is, the position detection controller 206 calculates, from V12 and V13 through linear interpolation, a voltage value Vlp necessary to cause the current with the current value Ip to flow through the secondary transfer roller 25 when the absolute water content is Ep in the relationship between the absolute water content and the voltage value in the case of the electric resistance value R1. Similarly, the position detection controller 206 calculates, from Vh2 and Vh3 through linear interpolation, a voltage value Vhp necessary to cause the current with the current value Ip to flow through the secondary transfer roller 25 when the secondary transfer roller 25 when the absolute water content is Ep in the relationship between the absolute water content and the voltage value in the case of the electric resistance value Rh. Then, the voltage value Vp necessary to cause the current with the current value Ip to flow through the secondary transfer roller 25 in the case of the electric resistance value Rp is calculated from a relationship between the voltage value Vlp and the voltage value Vhp. Then, the position detection controller 206 causes the voltage controller 204 to start application of the voltage (second test voltage) with the above-described voltage value Vp from the secondary transfer power source 26 to the secondary transfer roller 25 (t502). After a lapse of the time Tv1 until the output of the voltage is stabilized (t503), the position detection controller 206 causes the current detection controller 205 to acquire, S times (total time Ti) at a certain interval Ts, the current value detected by the current detection circuit 27. Then, the position detection controller 206 calculates an average (average current value) Iave1 of the current flowing through the secondary transfer roller 25 in a first position of the secondary transfer roller 25 when the fixing roller 51 is in the separated position (t504). The position detection controller 206 causes the predetermined storage area (the memory 212 such as the RAM) to store this average current value Iave1. Further, substantially at the same time, the position detection controller 206 causes the voltage controller 204 to stop application of the voltage (second test voltage) from the secondary transfer power source 26 to the secondary transfer roller 25 (t504).

Then, the position detection controller 206 causes the movement controller 203 to move the fixing roller 51 to the separated position in order to detect the current value of the current flowing through the secondary transfer roller 25 in a second position of the secondary transfer roller 25 when the fixing roller 51 is in the separated position. That is, after the application of the voltage (second test voltage) from the secondary transfer power source 26 to the secondary transfer roller 25 is stopped as described above (t504), the position detection controller awaits a lapse of a time Tv2 until the output of the secondary transfer power source 26 is stopped. Then, the position detection controller 206 causes the fixing motor 221 to start the reverse rotation when the time Tv2 has elapsed and then to start movement of the fixing roller 51 to the separated position again via the contact position (t505). Thereafter, when the position detection controller 206 detects that the signal from the phase detecting sensor 224 is switched from the contact detection signal to the separation detection signal (t506), the position detection controller 206 awaits until the time Tf has elapsed. Then, the position detection controller 206 causes the fixing motor 221 to stop the drive thereof when the time Tf has elapsed, so that the movement of the fixing roller 51 is completed (t507). Further, substantially at the same time, the position detection controller 206 causes the voltage controller 204 to start application of the voltage (second test voltage) from the secondary transfer power source 26 to the secondary transfer roller 25 (t507). After a lapse of the time Tv1 until the output of the voltage is stabilized (t508), the position detection controller 206 causes the current detection controller 205 to acquire, S times (total time Ti) at a certain interval Ts, the current value detected by the current detection circuit 27. Then, the position detection controller 206 calculates an average (average current value) Iave2 of the current flowing through the secondary transfer roller 25 in a second position of the secondary transfer roller 25 when the fixing roller 51 is in the separated position (t509). The position detection controller 206 causes the predetermined storage area (the memory 212 such as the RAM) to store this average current value Iave2. Further, substantially at the same time, the position detection controller 206 causes the voltage controller 204 to stop application of the voltage (second test voltage) from the secondary transfer power source 26 to the secondary transfer roller 25 (t509).

The position detection controller 206 compares the average current value Iave1 in the first position of the secondary transfer roller 25 and the average current value Iave2 in the second position of the secondary transfer roller 25 with each other. Then, the position detection controller 206 discriminates that the larger current value corresponds to the state D (in which the secondary transfer roller 25 is in the contact position) and that the smaller current value corresponds to the state B (in which the secondary transfer roller 25 is in the separated position). Further, the position detection controller 206 causes the predetermined storage area (the memory 212 such as the RAM) to store, for example, information for associating a present position (contact position or separated position) of the secondary transfer roller 25 and the phase of the fixing separation cam 222 with each other.

In the embodiment 3, during the image forming operation, in a state (in which the secondary transfer roller 25 is in the contact position) in which the secondary transfer roller 25 is contacted to the intermediary transfer belt 13, the electric resistance value Rpre of the secondary transfer roller 25 is acquired. Further, during the position detecting operation, the voltage value Vp necessary for causing the current with the predetermined current value Ip to flow through the secondary transfer roller 25 is acquired on the basis of the electric resistance value Rpre and the absolute water content Ep. Then, the voltage value Vp is determined as the voltage value of the voltage applied to the secondary transfer roller 25 when the position of the secondary transfer roller 25 is detected. Accordingly, the average current value Iave1 detected in the state in which the secondary transfer roller 25 is in the contact position becomes a value close to the above-described predetermined current value Ip. On the other hand, the average current value Iave2 detected in the state in which the secondary transfer roller 25 is in the separated position becomes a value smaller than the average current value Iave1 detected at the contact position.

Thus, according to the embodiment 3, irrespective of the electric resistance value of the secondary transfer roller 25, the current value of the current flowing through the secondary transfer roller 25 in the state in which the secondary transfer roller 25 is contacted to the intermediary transfer belt 13 can be caused to be brought close to the predetermined current value Ip. For that reason, irrespective of the electric resistance value of the secondary transfer roller 25, the position of the secondary transfer roller 25 (whether the secondary transfer roller 25 is in the contact position or the separated position) can be detected (discriminated) accurately. Further, flowing of the excessive current through the secondary transfer roller 25 is suppressed, so that simplification of the constitutions of the current detection circuit 27 and the secondary transfer roller 25 can be realized.

Incidentally, in the embodiment 3, the electric resistance value of the secondary transfer roller 25 is acquired during the image forming operation, but the present invention is not limited thereto. For example, the electric resistance value of the secondary transfer roller 25 may be acquired during an operation (during control operation, during adjusting operation) other than the image forming operation executed before the position detecting operation such as calibration (image density control or positional deviation correction control) or a process at the time of ON of the power source.

Further, during the position detecting operation, the electric resistance value Rpre may be calculated on the basis of the voltage value Vavepre and the current value Ipre.

5. Procedure of Position Detecting Operation

Next, using FIG. 17, a procedure of the position detecting operation in the embodiment 3 will be described. FIG. 17 is a flowchart showing the procedure of the position detecting operation in the embodiment 3.

The position detection controller 206 checks whether or not the fixing roller 51 is in the separated position (S801), and in the case where the fixing roller 51 is not in the contact position ("No" of S801), the position detection controller 206 causes the movement controller 203 to execute a separation operation in which the fixing roller 51 is moved to the separated position (S802). A procedure of this separation operation is the same as the procedure shown in part (a) of FIG. 8 described in the embodiment 1. Then, on the basis of the electric resistance value Rpre of the secondary transfer roller 25 acquired during the image forming operation and the absolute water content Ep detected by the environment sensor 226, the position detection controller 206 calculates the voltage value Vp as described above using FIG. 16 (S803). The position detection controller 206 causes the predetermined storage area (the memory 212 such as the RAM) to store this voltage value Vp. That is, the position detection controller 206 determines the voltage value Vp of the voltage applied to the secondary transfer roller 25 when the position of the secondary transfer roller 25 is detected.

Then, the position detection controller 206 causes the voltage controller 204 to apply the voltage (second test voltage) with the above-described voltage value Vp to the secondary transfer roller 25 (S804), and then awaits until the time Tv1 has elapsed ("No" of S805). Then, when the time Tv1 has elapsed ("Yes" of S805), the position detection controller 206 causes the current detection controller 205 to acquire, S times in an interval of the time Ts, the current value of the current flowing through the secondary transfer roller 25 (S806 to S808). When the current value is acquired S times ("Yes" of S807), the position detection controller 206 calculates the average of the acquired current values (average current value) Iave1 (S809). The position detection controller 206 causes the storage area (the memory 212 such as the RAM) to store this average current value Iave1. Further, the position detection controller 206 causes the voltage controller 204 to stop the application of the voltage (first test voltage) to the secondary transfer roller 25 (S810).

Then, the position detection controller 206 checks whether or not the average current value is calculated two times (S811). In the case where the average current value is not calculated two times ("No" of S811), similarly as the case of the above-described first calculation (acquiring process) of the average current value Iave1, the position detection controller 206 performs second calculation of the average current value Iave2 after the secondary transfer roller 25 is moved (S802 to S810).

When the position detection controller 206 performs the second calculation of the average current value Iave2 ("Yes" of S811), the position detection controller 206 compares an absolute value of a difference between the average current value Iave1 in the first calculation and the average current value Iave2 in the second calculation with an error threshold Ierr (S812). Then, in the case where the error threshold Ierr is larger than the absolute value of the difference ("Yes" of S812), the position detection controller 206 discriminates that detection of the position of the secondary transfer roller 25 failed (S813). In the case where the absolute value of the difference is not less than the error threshold Ierr ("No" of S812), the position detection controller 206 compares the average current value Iave1 in the first calculation and the average current value Iave2 in the second calculation with each other (S814). Then, in the case the average current value Iave2 is larger than the average current value Iave1 ("Yes" of S814), the position detection controller 206 discriminates that the present position of the secondary transfer roller 25 is the contact position (S815). Further, in the case where the average current value Iave1 is larger than the average current value Iave2 ("No" of S814), the position detection controller 206 discriminates that the present position of the secondary transfer roller 25 is the separated position (S816). In S815 and S816, the position detection controller 206 causes the storage area (the memory 212 such as the RAM) to store information for associating the present position of the secondary transfer roller 25 and the phase of the fixing separation cam 222 with each other.

6. Effect

As described above, in the embodiment 3, the position detection controller 206 executes the position detecting operation for detecting the position of the transfer member 25 by moving the transfer member 25 to the plurality of positions relative to the image bearing member 13 by the moving portion 223, and then on the basis of the detection result of the detecting portion 27 acquired by applying the first test voltage to the transfer member 25 before the position detecting operation is executed, the position detection controller 206 sets the second test voltage applied to the transfer member 25 in the position detecting operation. In the embodiment 3, the position detection controller 206 sets the second test voltage on the basis of the predetermined current value and the detection result of the voltage value by the detecting portion 27 acquired when the voltage value of the first test voltage is adjusted so that the current value of the current flowing through the transfer member 25 approaches a predetermined current value. Particularly, in the embodiment 3, the position detection controller 206 acquires the electric resistance value of the transfer member 25 on the basis of the predetermined current value and the detection result of the voltage value acquired under application of the first test voltage to the transfer member 25, and then sets the second test voltage on the basis of the electric resistance value.

Further, according to the embodiment 3, even in the case where the electric resistance value of the secondary transfer roller 25 changes, the position of the secondary transfer roller 25 can be detected (discriminated) accurately. Further, flowing of the excessive current through the secondary transfer roller 25 is suppressed, so that it becomes possible to realize simplification of constitutions of the current detection circuit 27 and the secondary transfer roller 25. Further, according to the embodiment 3, the process time of the position detecting operation can be made shorter than the process times in the embodiments 1 and 2.

As described above, the present invention was described based on the specific embodiments, but the present invention is not limited to the above-described embodiments.

In the above-described embodiments, the separation cam was used for moving the fixing roller 51 and the secondary transfer roller 25. However, the present invention is not limited thereto. For example, a separation lever or the like for moving the fixing roller 51 and the secondary transfer roller 25 may be used. The separation lever can be constituted to be swingable so that, for example, the bearing member for the fixing roller 51 and the bearing member for the secondary transfer roller 25 are moved in a direction in which the fixing roller 51 or the secondary transfer roller 25 moves toward or away from an opposite member thereof.

Further, in the above-described embodiments, the current flowing through the secondary transfer roller 25 in one state and the other state in which the secondary transfer roller 25 was in one of the contact position and the separated position is detected, and the position of the secondary transfer roller 25 was detected (discriminated) on the basis of the difference therebetween. By this, whether the secondary transfer roller 25 in the contact position or the separated position can be accurately detected (discriminated). Further, by this, failure in detection of the position of the secondary transfer roller 25 can be accurately detected. However, the present invention is not limited thereto. For example, in the above-described embodiments, the voltage value of the voltage applied to the secondary transfer roller 25 when the position of the secondary transfer roller 25 is detected was set so that the current with the predetermined current value flows through the secondary transfer roller 25 in the state in which the secondary transfer roller 25 is in the contact position. In such a case, when a current which is not less than a predetermined threshold set in advance flows through the secondary transfer roller 25 under application of the voltage with the voltage value to the secondary transfer roller 25, detection (discrimination) that the secondary transfer roller 25 is in the separated position in the case where only the current less than the threshold flows at the contact position may be made.

Further, in the above-described embodiments, the present invention is applied to the image forming apparatus (color image forming apparatus) of the tandem type, but the present invention is also applicable to a monochromatic image forming apparatus for black (single color), for example. In this case, for example, the present invention may only be required to be applied to a transfer portion where the toner image is transferred from the image bearing member such as the photosensitive drum onto the transfer material.

Further, in the above-described embodiments, the transfer member was the roller-shaped member, but the present invention is not limited thereto. The transfer member may also be a brush-shaped member which is constituted by including brush fibers having elasticity and which is fixedly disposed or rotatable or a film-shaped (sheet-shaped) member having elasticity (flexibility), or the like member.

According to the present invention, even in the case where the electric resistance value of the transfer member changed, the position of the transfer member can be accurately detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-072939 filed on Apr. 22, 2021, which is hereby incorporated by reference herein in its entirety.

What is claimed is:

1. An image forming apparatus comprising:

an image bearing member configured to bear a toner image;

a transfer member configured to form a transfer portion where the toner image is transferred from said image bearing member onto a transfer material in contact with said image bearing member;

a moving portion configured to move said transfer member, relative to said image bearing member, to a plurality of positions including a contact position where said transfer member is contacted to said image bearing member to and a separated position where said transfer member is separated from said image bearing member;

a driving portion configured to drive said moving portion;

an applying portion configured to apply a voltage to said transfer member;

a first detecting portion configured to detect at least one of a voltage applied to said transfer member by said applying portion and a current flowing through said transfer member when the voltage is applied to said transfer member by said applying portion; and a second detecting portion configured to detect a position of said transfer member, wherein on the basis of a detection result of said first detecting portion acquired when a first test voltage is applied to said transfer member by said applying portion, said second detecting portion sets a second test voltage, and wherein said second detecting portion detects the position of said transfer member on the basis of a detection result of a current value by said first detecting portion acquired when the second test voltage is applied to said transfer member by said applying portion.

2. An image forming apparatus according to claim 1, wherein in a case that a position detecting operation for detecting the position of said transfer member by moving said transfer member to the positions relative to said image bearing member by said moving portion is performed, said second detecting portion sets the second test voltage applied to said transfer member in the position detecting operation on the basis of the detection result of said first detecting portion acquired by applying the first test voltage to said transfer member.

3. An image forming apparatus according to claim 2, wherein said second detecting portion sets the second test voltage on the basis of a detection result of a voltage value by said first detecting portion acquired when a voltage value of the first test voltage is adjusted so that a current value of the current flowing through said transfer member approaches a predetermined current value.

4. An image forming apparatus according to claim 2, wherein said second detecting portion sets the second test voltage on the basis of a detection result of a current value of a current by said first detecting portion acquired when the first test voltage with a predetermined voltage value is applied to said transfer member and on the basis of the predetermined voltage value.

5. An image forming apparatus according to claim 4, wherein said second detecting portion acquires an electric resistance value on the basis of the detection result of the current value and the predetermined voltage value, and wherein said second detecting portion sets the second test voltage on the basis of the electric resistance value.

6. An image forming apparatus according to claim 1, wherein said second detecting portion carries out control so that a position detecting operation for detecting the position of said transfer member by moving said transfer member to the positions relative to said image bearing member by said moving portion is executed, and wherein said second detecting portion sets the second test voltage applied to said transfer member in the position detecting operation, on the basis of the detection result of said detecting portion acquired by applying the first test voltage to said transfer member before the position detecting operation is executed.

7. An image forming apparatus according to claim 6, wherein said second detecting portion sets the second test voltage on the basis of the detection result of said first detecting portion acquired by applying the first test voltage to said transfer member in a preparation operation when an image forming operation is executed.

8. An image forming apparatus according to claim 6, wherein said second detecting portion sets the second test voltage on the basis of a detection result of a voltage value by said first detecting portion acquired when a voltage value of the first test voltage is adjusted so that a current value of the current flowing through said transfer member approaches a predetermined current value and on the basis of the predetermined current value.

9. An image forming apparatus according to claim 8, wherein said second detecting portion sets the second test voltage on the basis of an electric resistance value of said transfer member acquired on the basis of the predetermined current value and the detection result of the voltage value acquired by applying the first test voltage to said transfer member.

10. An image forming apparatus according to claim 2, wherein said second detecting portion i) acquires, in the position detecting operation, the detection result of the current value by said detecting portion by applying the second test voltage to said transfer member by said applying portion when said transfer member is put in each of a first position and a second position which are one and the other of the contact position and the separated position, respectively, by being moved to the first position and the second position, ii) outputs at least one of information indicating that the first position is the contact position and information indicating that the second position is the separated position in a case that the current value acquired when said transfer member is in the first position is higher than the current value acquired when said transfer member is in the second position, and iii) outputs at least one of the information indicating that the first position is the contact position and the information indicating that the second position is the separated position in a case that the current value acquired when said transfer member is in the first position is lower than the current value acquired when said transfer member is in the second position.

11. An image forming apparatus according to claim 10, wherein in a case that a difference between the current value acquired when said transfer member is in the first position and the current value acquired when said transfer member is in the second position is lower than a predetermined value, said second detecting portion outputs information indicating failure in detection of the position of said transfer member.

12. An image forming apparatus according to claim 1, wherein said second detecting portion sets the second test voltage on the basis of a detection result of said first detecting portion acquired in a state in which said transfer member is in the contact position.

13. An image forming apparatus according to claim 1, further comprising:

a driven portion movable between a first predetermined position and a second predetermined position by being driven by said driving portion common to said moving portion and said driven portion; and a sensor configured to detect a position of said driven portion, wherein said transfer member is in the contact position in a state in which said sensor detects that said driven portion is in the first predetermined position, wherein said transfer member is in the contact position or the separated position in a state in which said sensor detects that said driven portion is in the second predetermined position, wherein said second detecting portion sets the second test voltage on the basis of a detection result of a current value by said first detecting portion acquired in the state in which said sensor detects that said driven portion is in the first predetermined position, and wherein said second detecting portion detects the position of said transfer member on the basis of a detection result of a current value by said first detecting portion acquired in the state in which said sensor detects that said driven portion is in the second predetermined position.

14. An image forming apparatus according to claim 13, wherein said driven portion is a member configured to move a fixing member for fixing the toner image on the transfer material.

15. An image forming apparatus according to claim 1, wherein said moving portion is capable of moving said transfer member to, as the contact position, a first contact position and a second contact position, and wherein a contact pressure of said transfer member to said image bearing member is higher when said transfer member is in the first contact position than when said transfer member is in the second position.

* * * * *